US012213518B2

(12) United States Patent
Mishra et al.

(10) Patent No.: US 12,213,518 B2
(45) Date of Patent: Feb. 4, 2025

(54) METHOD OF MAKING E-VAPING DEVICE WITH INSERT

(71) Applicant: Altria Client Services LLC, Richmond, VA (US)

(72) Inventors: Munmaya K. Mishra, Richmond, VA (US); Danielle Crawford, Richmond, VA (US); Dwight David Williams, Powhatan, VA (US); Eric Hawes, Midlothian, VA (US); Terry Bache, Richmond, VA (US); Raymond W. Lau, Richmond, VA (US); Shaoyong Yu, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 430 days.

(21) Appl. No.: 17/707,006

(22) Filed: Mar. 29, 2022

(65) Prior Publication Data

US 2022/0218026 A1 Jul. 14, 2022

Related U.S. Application Data

(62) Division of application No. 16/125,399, filed on Sep. 7, 2018, now Pat. No. 11,311,048.

(51) Int. Cl.

| | |
|---|---|
| ***A24F 47/00*** | (2020.01) |
| ***A24B 15/167*** | (2020.01) |
| ***A24D 1/14*** | (2006.01) |
| ***A24F 7/04*** | (2006.01) |
| ***A24F 40/10*** | (2020.01) |

(Continued)

(52) U.S. Cl.

CPC ..... *A24F 40/40* (2020.01); *A24B 15/167* (2016.11); *A24D 1/14* (2013.01); *A24F 7/04* (2013.01); *A24F 40/10* (2020.01); *A24F 40/42* (2020.01)

(58) Field of Classification Search

CPC ..... A24F 40/30

See application file for complete search history.

(56) References Cited

U.S. PATENT DOCUMENTS

| | | | |
|---|---|---|---|
| 3,255,760 | A | 6/1966 | Selke et al. |
| 3,640,285 | A | 2/1972 | Briskin et al. |
| 4,210,158 | A | 7/1980 | Vinals et al. |

(Continued)

FOREIGN PATENT DOCUMENTS

| | | | |
|---|---|---|---|
| CN | 101442917 | A | 5/2009 |
| CN | 101657114 | A | 2/2010 |

(Continued)

OTHER PUBLICATIONS

European Office Action dated Sep. 29, 2022, issued in corresponding European Patent Application No. 19 753 575.0.

(Continued)

*Primary Examiner* — Eric Yaary

(74) *Attorney, Agent, or Firm* — Harness, Dickey & Pierce, P.L.C.

(57) ABSTRACT

The method including providing a filler material that is water insoluble, the providing provides the filler material with more than 98% alpha-cellulose, 0.01% to less than 2% ash and a remainder hemicellulose, infusing at least one first consumable within the filler material and inserting a matrix within at least one first containing structure to form an insert, the matrix including the filler material.

21 Claims, 12 Drawing Sheets

(51) Int. Cl.
*A24F 40/40* (2020.01)
*A24F 40/42* (2020.01)

(56) References Cited

U.S. PATENT DOCUMENTS

| | | | | |
|---|---|---|---|---|
| 4,357,950 | A | 11/1982 | Berger | |
| 4,649,944 | A | 3/1987 | Houck, Jr. et al. | |
| 4,807,809 | A | 2/1989 | Pryor et al. | |
| 4,889,143 | A | 12/1989 | Pryor et al. | |
| 4,903,714 | A | 2/1990 | Barnes et al. | |
| 4,936,920 | A | 6/1990 | Keritsis et al. | |
| 5,005,593 | A | 4/1991 | Fagg | |
| 5,016,656 | A | 5/1991 | McMurtrie | |
| 5,025,814 | A | 6/1991 | Raker | |
| 5,060,669 | A | 10/1991 | White et al. | |
| 5,074,320 | A | 12/1991 | Jones, Jr. et al. | |
| 5,105,836 | A | 4/1992 | Gentry et al. | |
| 5,129,409 | A | 7/1992 | White et al. | |
| 5,203,355 | A | 4/1993 | Clearman et al. | |
| 5,269,327 | A | 12/1993 | Counts et al. | |
| 5,360,023 | A | 11/1994 | Blakley et al. | |
| 5,396,909 | A | 3/1995 | Gentry et al. | |
| 5,396,911 | A | 3/1995 | Casey, III et al. | |
| 5,505,214 | A | 4/1996 | Collins et al. | |
| 5,685,323 | A | 11/1997 | Crooks et al. | |
| 5,829,453 | A | 11/1998 | White et al. | |
| 5,863,652 | A | 1/1999 | Matsumura et al. | |
| 6,289,897 | B1 | 9/2001 | McAdam et al. | |
| 7,578,298 | B2 | 8/2009 | Karles et al. | |
| 7,647,932 | B2 | 1/2010 | Cantrell et al. | |
| 7,726,320 | B2 | 6/2010 | Robinson et al. | |
| 8,113,215 | B2 | 2/2012 | Rasouli et al. | |
| 8,157,918 | B2 | 4/2012 | Becker et al. | |
| 8,186,360 | B2 | 5/2012 | Marshall et al. | |
| 8,464,726 | B2 | 6/2013 | Sebastian et al. | |
| 8,739,802 | B2 | 6/2014 | Fagg | |
| 8,967,155 | B2 | 3/2015 | Bundren et al. | |
| 9,004,073 | B2 | 4/2015 | Tucker et al. | |
| 9,066,541 | B2 | 6/2015 | Allen et al. | |
| 9,072,321 | B2 | 7/2015 | Liu | |
| 9,220,301 | B2 | 12/2015 | Banerjee et al. | |
| 9,402,422 | B2 | 8/2016 | Shenkal | |
| 2005/0053665 | A1 | 3/2005 | Ek et al. | |
| 2005/0263165 | A1 | 12/2005 | Oh et al. | |
| 2007/0056600 | A1 | 3/2007 | Coleman et al. | |
| 2010/0147317 | A1 | 6/2010 | Fallon | |
| 2011/0036367 | A1 | 2/2011 | Saito et al. | |
| 2011/0271971 | A1 | 11/2011 | Conner et al. | |
| 2012/0067359 | A1 | 3/2012 | Clarke et al. | |
| 2012/0125354 | A1 | 5/2012 | Byrd et al. | |
| 2012/0186594 | A1 | 7/2012 | Liu | |
| 2013/0192615 | A1 | 8/2013 | Tucker et al. | |
| 2013/0192620 | A1 | 8/2013 | Tucker et al. | |
| 2014/0166032 | A1 | 6/2014 | Gindrat | |
| 2014/0224268 | A1 | 8/2014 | Ryter | |
| 2014/0261486 | A1 | 9/2014 | Potter et al. | |
| 2015/0000682 | A1 | 1/2015 | Liu | |
| 2015/0027468 | A1 | 1/2015 | Li et al. | |
| 2015/0027469 | A1 | 1/2015 | Tucker et al. | |
| 2015/0209530 | A1* | 7/2015 | White | A24D 1/20 128/200.23 |
| 2015/0305410 | A1 | 10/2015 | Liu | |
| 2016/0106154 | A1 | 4/2016 | Lord | |
| 2016/0120224 | A1 | 5/2016 | Mishra et al. | |
| 2016/0135506 | A1* | 5/2016 | Sanchez | A24F 40/30 131/329 |
| 2016/0143348 | A1 | 5/2016 | Camus et al. | |
| 2016/0208440 | A1* | 7/2016 | Byrd, Jr. | B65D 85/1045 |
| 2016/0295909 | A1 | 10/2016 | Besso et al. | |
| 2016/0295914 | A1 | 10/2016 | Jordil et al. | |
| 2016/0295922 | A1 | 10/2016 | John et al. | |
| 2016/0295926 | A1 | 10/2016 | Zuber | |
| 2016/0302477 | A1 | 10/2016 | Besso | |
| 2016/0324216 | A1* | 11/2016 | Li | A24F 40/42 |
| 2017/0064995 | A1 | 3/2017 | Beeson | |
| 2017/0145634 | A1 | 5/2017 | Bradbury et al. | |
| 2017/0251723 | A1 | 9/2017 | Kobal et al. | |
| 2018/0007966 | A1 | 1/2018 | Li et al. | |
| 2018/0146713 | A1 | 5/2018 | Robinson et al. | |
| 2018/0177233 | A1 | 6/2018 | Tucker et al. | |
| 2019/0124982 | A1* | 5/2019 | Atkins | A61M 11/042 |

FOREIGN PATENT DOCUMENTS

| | | | |
|---|---|---|---|
| CN | 101778577 | A | 7/2010 |
| CN | 103796537 | A | 5/2014 |
| CN | 105163611 | A | 12/2015 |
| CN | 107635419 | A | 1/2018 |
| CN | 108201169 | A | 6/2018 |
| EP | 0532329 | A2 | 3/1993 |
| EP | 0569964 | A2 | 11/1993 |
| GB | 1055473 | A | 1/1967 |
| RU | 2110198 | C1 | 5/1998 |
| RU | 2462964 | C2 | 10/2012 |
| RU | 2520878 | C2 | 6/2014 |
| RU | 148293 | U1 | 11/2014 |
| RU | 2565566 | C2 | 10/2015 |
| RU | 2581999 | C2 | 4/2016 |
| RU | 2603597 | C2 | 11/2016 |
| RU | 2612998 | C9 | 5/2017 |
| RU | 2657215 | C2 | 6/2018 |
| SU | 483816 | A3 | 9/1975 |
| SU | 1837814 | A3 | 8/1993 |
| WO | WO-2004/041007 | A2 | 5/2004 |
| WO | WO-2006/117697 | A1 | 11/2006 |
| WO | WO-2007/053097 | A1 | 5/2007 |
| WO | WO-2013034512 | A1 | 3/2013 |
| WO | WO-2013/116558 | A1 | 8/2013 |
| WO | 2014/116974 | A1 | 7/2014 |
| WO | WO-2014/180893 | A1 | 11/2014 |
| WO | WO-2015/013108 | A2 | 1/2015 |
| WO | WO-2015/013135 | A1 | 1/2015 |
| WO | WO-2015/179388 | A1 | 11/2015 |
| WO | WO-2016/159013 | A1 | 10/2016 |
| WO | WO-2017/009298 | A1 | 1/2017 |
| WO | WO-2017/093358 | A1 | 6/2017 |
| WO | WO-2017/174595 | A1 | 10/2017 |
| WO | WO-2018/007633 | A1 | 1/2018 |
| WO | WO-2018/050610 | A1 | 3/2018 |

OTHER PUBLICATIONS

Office Action and Search Report dated Dec. 13, 2022, issued in corresponding Russian Patent Application No. 2021109408.

Office Action dated Aug. 9, 2023, issued in corresponding Chinese Patent Application No. 201980052985.3.

Japanese Office Action dated Sep. 28, 2023 for corresponding Japanese Patent Application 2021-512520 and its English-language translation.

Chinese Office Action, dated Mar. 2, 2024, issued in Chinese Patent Application No. 201980052983.4.

Japanese Office Action, dated Aug. 18, 2023, issued in corresponding Japanese Patent Application No. 2021-512512.

Notice of Opposition dated Aug. 8, 2023, issued in corresponding European Patent EP3846643.

Decision to Grant dated Jul. 26, 2023, issued in corresponding Russian Patent Application No. 2021109408/03.

Rejection Decision issued Nov. 8, 2023 in Chinese Application No. 201980052985.3.

Chinese Office Action, dated Sep. 6, 2023, issued in corresponding Chinese Patent Application No. 201980052983.4.

"Active Paper Filter", Essentra, Hyperlink "http://www.essentra.com/en/industries/tobacco/filter-range/performance-range/performance-range/vapour-red" www.essentra.com/en/industries/tobacco/filter-range/performance-range/performance-range/vapour-red . . . , Mar. 25, 2018.

'Additives in Tobacco Products: Cellulose Fibre' German Cancer Research Center, Jan. 2012, https://www.dkfz.de/de/tabakkontrolle/download/PITOC/PITOC_Tobacco_Additives_Cellulose_Fibre.pdf.

(56) References Cited

OTHER PUBLICATIONS

International Search Report and Written Opinion dated Oct. 29, 2019, issued in corresponding PCT Application No. PCT/US2019/045096.
International Search Report and Written Opinion dated Nov. 27, 2019, issued in corresponding PCT Application No. PCT/EP2019/073881.
International Search Report and Written Opinion dated Nov. 27, 2019, issued in corresponding PCT Application No. PCT/EP2019/073892.
International Preliminary Report on Patentability dated Sep. 29, 2020, issued in corresponding International Application No. PCT/EP2019/073881.
International Preliminary Report on Patentability dated Mar. 18, 2021, issued in corresponding International Application No. PCT/US2019/045096.
International Preliminary Report on Patentability dated Mar. 18, 2021, issued in corresponding International Application No. PCT/EP2019/073892.
Office Action dated Sep. 10, 2021, issued in corresponding U.S. Appl. No. 16/125,393.
Office Action dated Oct. 6, 2021, issued in corresponding U.S. Appl. No. 16/125,293.
European Office Action dated Feb. 10, 2022, issued in corresponding European Patent Application No. 19 753 575.0.
Notice of Allowance dated Jun. 1, 2023, issued in corresponding Russian Patent Application No. 2021108891.
Office Action dated May 2, 2023 issued in related European Patent Application No. 19753575.0.
Office Action dated Mar. 28, 2023, issued in corresponding Brazilian Patent Application No. 112021002939-7.
Office Action and Search Report dated Dec. 22, 2022, issued in corresponding Russian Patent Application No. 2021108891.
Japanese Office Action, dated Apr. 22, 2024, issued in Japanese Patent Application No. 2021-512520.
Notice of Allowance, dated Dec. 20, 2023, issued in U.S. Appl. No. 17/902,271.
Office Action, dated Jun. 20, 2024, issued in U.S. Appl. No. 17/872,394.
Chinese Office Action, dated Jul. 9, 2024, issued in Chinese Patent Application No. 201980052985.3.
Notice of Allowance dated May 3, 2022 issued in corresponding U.S. Appl. No. 16/125,293.
Office Action and Search Report dated Jan. 28, 2023, issued in corresponding Chinese Patent Application No. 201980052985.3.
Japanese Office Action, dated Mar. 26, 2024, issued in Japanese Patent Application No. 2021-512512.
Chinese Office Action, dated Aug. 29, 2024, issued in Chinese Patent Application No. 201980052983.4.
Japanese Notice of Allowance, dated Sep. 17, 2024, issued in Japanese Patent Application No. 2021-512520.
Final Office Action, dated Dec. 10, 2024, issued in U.S. Appl. No. 17/872,394.
Japanese Pre-Appeal Review Report, dated Sep. 26, 2024, issued in Japanese Patent Application No. 2021-512512.
Extended European Search Report, dated Nov. 22, 2024, issued in European Patent Application No. 24186044.4.

* cited by examiner

METHOD OF MAKING E-VAPING DEVICE WITH INSERT

CROSS-REFERENCE TO RELATED APPLICATIONS

This application is a divisional of U.S. application Ser. No. 16/125,399, filed on Sep. 7, 2018, the entire contents of which is incorporated herein by reference.

BACKGROUND

Field

Example embodiments generally relate to an electronic vaping (e-vaping) device with an insert.

Related Art

An e-vaping device uses a heater to at least partially volatilize a pre-vapor formulation.

SUMMARY

At least one example embodiment is directed toward a device.

In one example embodiment, the device includes at least one first section including, an airflow passage, a first reservoir configured to contain at least one first pre-vapor formulation, a heater in communication with the first reservoir and the airflow passage, the heater being configured to at least partially vaporize the at least one first pre-vapor formulation, and an insert in communication with the airflow passage, the insert being downstream of the heater, the insert including, a matrix including one or more portions of a filler material, the filler material being a plant-based cellulose material, the one or more portions defining interstices; at least one first containing structure containing the matrix, the at least one first containing structure contacting at least side surfaces of the matrix, and at least one first consumable substance infused within the filler material, the at least one first consumable substance including at least one of nicotine, at least one first flavorant, at least one second pre-vapor formulation, a sub-combinations thereof, or a combinations thereof.

In one example embodiment, the filler material includes plant-based cellulose material.

In one example embodiment, the filler material includes cellulose material.

In one example embodiment, the filler material includes a non-tobacco material and does not include any material from tobacco.

In one example embodiment, the filler material includes tobacco.

In one example embodiment, the containing structure contacts at least a side surface of the matrix.

In one example embodiment, the containing structure is wrapped around the matrix in a longitudinal direction thereby containing the matrix, and at least one end of the matrix is not wrapped by the containing structure.

In one example embodiment, the containing structure is wrapped around the matrix in a longitudinal direction thereby containing the matrix, and at least two ends of the matrix are not wrapped by the containing structure.

In one example embodiment, the containing structure is a wrapping wrapped around the matrix thereby containing the matrix.

In one example embodiment, the containing structure includes paper.

In one example embodiment, the paper includes tipping paper.

In one example embodiment, the containing structure includes the same material as the filler material.

In one example embodiment, the nicotine is synthetic.

In one example embodiment, the nicotine is derived from tobacco.

In one example embodiment, the first pre-vapor formulation and the second pre-vapor formulation include the same ingredients.

In one example embodiment, the first pre-vapor formulation and the second pre-vapor formulation include different ingredients.

In one example embodiment, the insert is a removable insert.

In one example embodiment, the insert is configured to insert into an end of the device, and a part of the insert is configured to extend out of the device when the insert is inserted into the end of the device.

In one example embodiment, the insert further includes a filter.

In one example embodiment, the containing structure is wrapped around the matrix thereby containing the matrix, and the containing structure is also wrapped around the filter.

In one example embodiment, the insert further includes a space between the matrix and the filter.

In one example embodiment, the containing structure is wrapped around the matrix thereby containing the matrix, and the containing structure is also wrapped around the filter and the space.

In one example embodiment, the insert further includes a flow restrictor.

In one example embodiment, the containing structure is wrapped around the matrix thereby containing the matrix, and the containing structure is also wrapped around the flow restrictor.

In one example embodiment, the insert further includes a filter and a flow restrictor.

In one example embodiment, the containing structure is wrapped around the matrix thereby containing the matrix, and the containing structure is also wrapped around the filter and the flow restrictor.

In one example embodiment, the insert further includes a space, and the containing structure is also wrapped around the space.

In one example embodiment, the first pre-vapor formulation does not include nicotine.

In one example embodiment, the first pre-vapor formulation includes nicotine.

In one example embodiment, the one or more portions of a filler material include cut portions of the filler material.

In one example embodiment, the one or more portions of a filler material include a folded portion of the filler material.

In one example embodiment, the device further includes a control system in electrical communication with the heater, the control system being configured to detect at least one first parameter, the at least one first parameter being at least one of a resistance of the heater, a temperature of the heater, a draw of air in the airflow passage, a sub-combination thereof, or a combination thereof, and the control system being configured to send an electrical current to the heater based on the at least one first parameter.

In one example embodiment, the control system being configured to detect at least one first parameter, the at least one first parameter being at least one of a resistance of the heater, a temperature of the heater, a draw of air in the airflow passage, a sub-combination thereof, or a combination thereof, and the control system being configured to send the electrical current to the heater based on the at least one first parameter.

In one example embodiment, the insert further includes, a flow restriction section with a first end and a second end, the first end of the flow restriction section being connected to the matrix, the flow restriction section defining an internal void space with a flow restrictor in the internal void space, the flow restrictor being spaced apart from the first end and the second end of the flow restriction section, a non-consumable filter connected to the second end of the flow restriction section, and wherein the at least one first containing structure contacts at least side surfaces of the flow restriction section and the non-consumable filter to contain the matrix, the flow restriction section and the non-consumable filter together, wherein the insert is configured to selectively insert into a distal end of the at least one first section to cause the non-consumable filter to extend from the at least one first section.

In one example embodiment, the control system is configured to detect at least one first parameter, the at least one first parameter being at least one of a resistance of the heater, a temperature of the heater, a draw of air in the airflow passage, a sub-combination thereof, or a combination thereof, and the control system being configured to send the electrical current to the heater based on the at least one first parameter.

In one example embodiment, the insert further includes, a filter connected to the second end of the flow restriction section.

In one example embodiment, the containing structure contacts at least a side surface of the matrix, at least a side surface of the flow restrictor and at least a side surface of the filter to contain the matrix, the flow restrictor and the filter together.

In one example embodiment, the insert is configured to removably insert into an end of the device, and a portion of the filter is configured to extend out of the device when the insert is inserted into the end of the device.

In one example embodiment, the device further includes a second reservoir in fluid communication with the matrix of the insert, the second reservoir being configured to contain at least one of nicotine, the at least one first flavorant, the at least one second pre-vapor formulation, a sub-combination thereof, or a combinations therefore.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
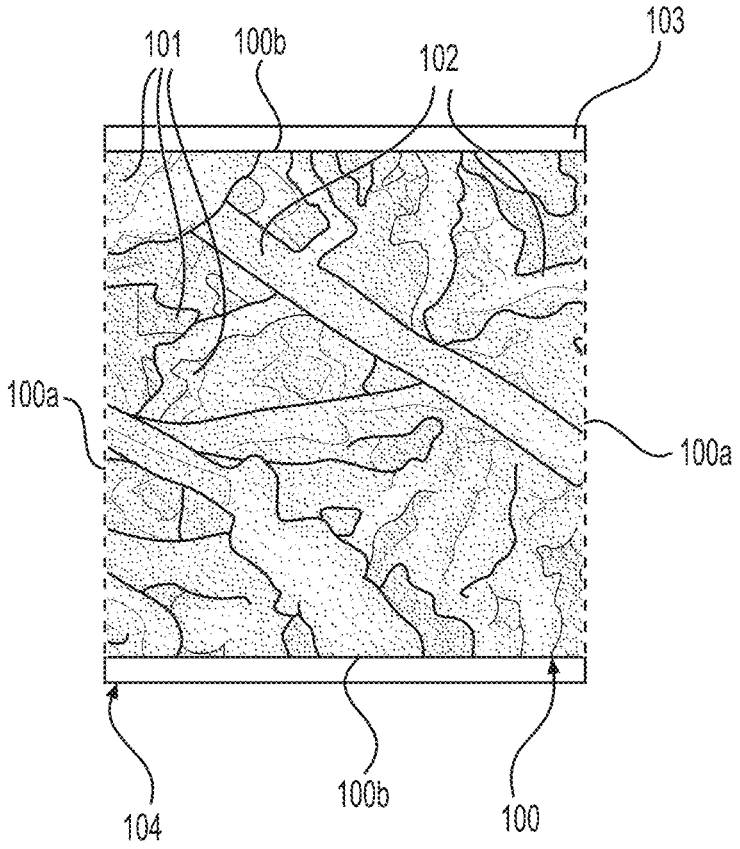
FIG. 1 is an illustration of an insert containing a matrix, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIG. 1 is an illustration of an insert 104 containing a matrix 100, in accordance with an example embodiment. In an example embodiment, the matrix 100 includes cut strands 102 of a filler material 105 (see FIG. 2A/B). The strands 102 define interstices 101 that provide avenues for airflow traveling through the matrix 100. In another example embodiment, in lieu of cutting the filler material 105 into strands 102 to form the matrix 100, or in addition to the cut strands 102 that form the matrix 100, filler material 105 can be folded, layered, bunched together, otherwise combined and/or compressed into the matrix 100.

In some example embodiments, the filler material 105 may also be perforated to increase a porosity and/or flow paths through the filler material 105 that is combined to form the matrix 100. In an example embodiment, the matrix 100 is a porous material, that may be a composite material made from tobacco, non-tobacco materials, or both tobacco and non-tobacco materials. In some example embodiments, the matrix 100 is provided with or without flavors, and the matrix 100 is provided with or without nicotine.

In an example embodiment, the matrix 100 is contained (e.g., bound together) by a containing structure 103. The matrix 100 and containing structure 103 may combine to form the insert 104 or a part of the insert 104. An insert 104 can be in various shapes or sizes and may include other elements. In an example embodiment, the insert 104 is in the shape of a plug that is sized to be fitted into a housing 6*b*, or on the end of a housing 6*b*, of a device (as shown in FIGS. 3-8). In an example embodiment, the insert 104 is sized to include enough matrix 100, and a concentration of nicotine and/or flavoring (described below) within the matrix 100 to provide a determined number of draws and/or a determined number of draws over a desired duration of time.

In an example embodiment, the containing structure 103 fully circumscribes the matrix 100. In another embodiment, the containing structure 103 does not cover all sides of the matrix 100, and may for instance define openings for an entrance and exit airflow on ends 100*a* of the matrix 100. The containing structure 103 may be made from more than one material. In an example embodiment, the containing structure 103 may include a soft and/or porous covering. In an example embodiment, the containing structure 103 may include a covering made from cellulose, plant-based cellulose, fabric, cotton, fibers, threads, other suitable textiles, paper, tipping paper, or combinations or sub-combinations of these materials, etc. In an example embodiment, the containing structure 103 may include a hard shell made from metal, metal alloys, one or more polymers, plastics, resins, etc., where the hard shell may or may not essentially circumscribe the matrix 100. In the event the containing structure 103 is a hard shell that covers all sides of the matrix 100, at least one or more openings and/or perforations in the shell may be included to allow airflow to contact and/or flow through at least a portion of the matrix 100. In an example embodiment, the ends 100*a* and/or sides 100*b* of the matrix 100 are covered with a containing structure 103 that is made from a porous material, and may include a mesh, such as a metal, plastic, resin and/or polymer mesh. The ends 100*a* and/or sides 100*b* of the matrix 100 may also, in an example embodiment, be covered by a containing structure 103 that is a soft and/or porous covering made from cellulose, plant-based cellulose, fabric, cotton, fibers, threads, other suitable textiles, paper, tipping paper, or combinations or sub-combinations of these materials, etc. In an example embodiment, the containing structure 103 is made from the filler material 105.

The containing structure 103 and/or the matrix 100 of some example embodiments is suitable for allowing airflow to pass along and/or through at least a portion of the matrix 100. In some example embodiments, the containing structure 103 may allow airflow to pass through at least a portion of the containing structure 103, itself. In an example embodiment, the matrix 100 does not include a containing structure 103.

In an example embodiment, the containing structure 103 and/or the matrix 100 can be in the shape of a cylinder, a rod, a disc, a flat surface, a square, a rectangle, or any other desirable shape. In an example embodiment, matrix 100 may be in the shape of a cylinder, and containing structure 103 may be wrapped around the cylinder without covering ends 100*a*. Other shapes or cross-sectional configurations may be used. In another embodiment, the insert 104 does not include a containing structure 103, and instead, for example, the insert 104 includes only the matrix 100 consisting of portions of the filler material 105, either in the form of strands 102, and/or in another form other than strands 102.

Physical Characteristics of Matrix/Insert According to Some Example Embodiments

In an example embodiment, the filler material 105 is packed such that the density and porosity of the matrix 100 form an insert 104 with a resistance to draw (RTD) of about 5 mm of water to about 40 mm of water. In an example embodiment, the RTD of the insert 104 is about 18 mm of water to 25 mm of water. Any other density and/or porosity may be used to lead to a desired RTD. For example, in some embodiments, the RTD of the insert 104 may be below 5 mm of water or above 40 mm of water. It should be understood that in some embodiments the RTD of the insert 104 lessens over time as the insert 104 is in used.

Filler Material According to Some Example Embodiments

Figure 2A:
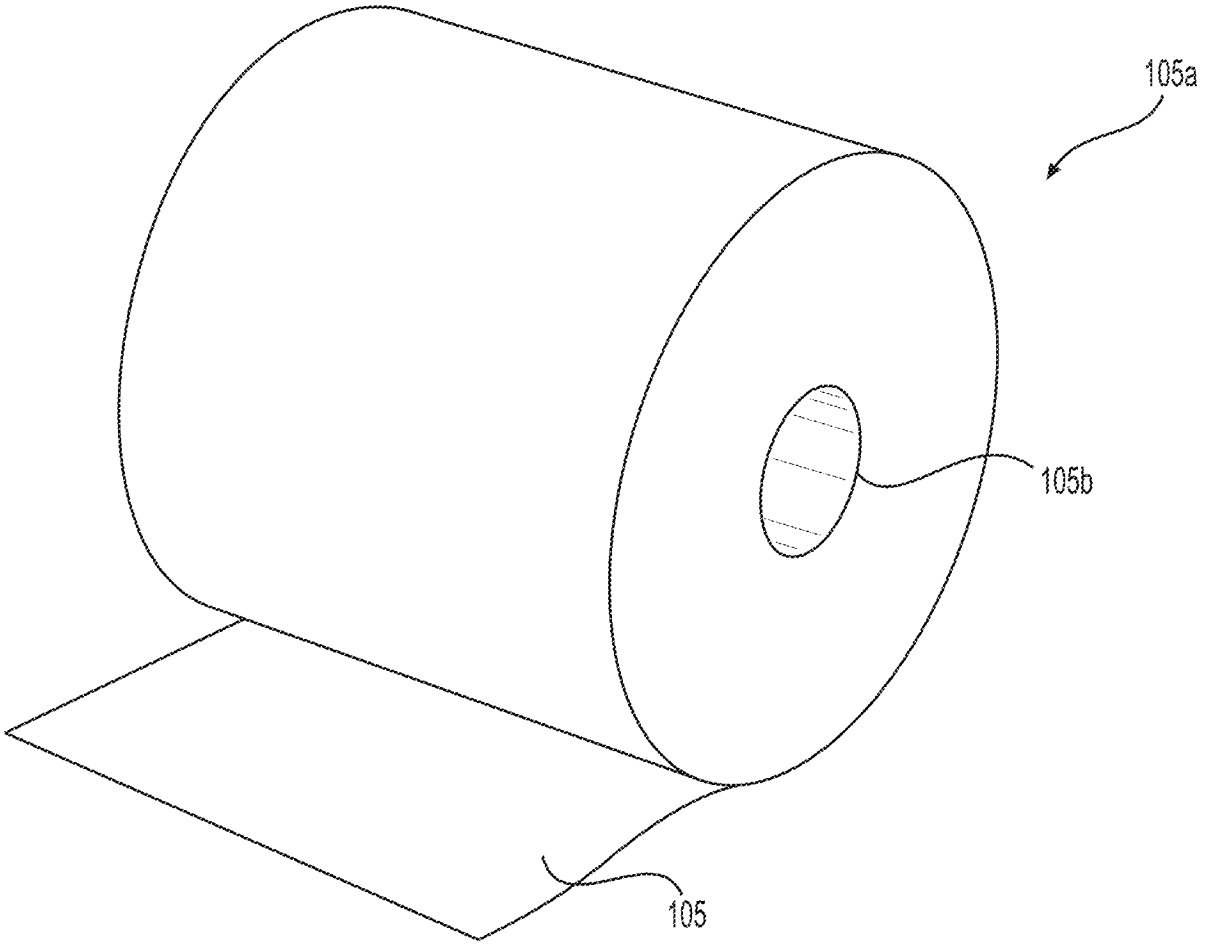
FIG. 2A is an illustration of a roll of filler material, in accordance with an example embodiment.

FIG. 2A is an illustration of a roll 105*a* of filler material 105, in accordance with an example embodiment. In this embodiment, the filler material 105 is a flat-sheet-like material, where the filler material 105 may be processed and/or stored onto rolls 105*a* for convenience. The roll 105*a* may optionally include a mandrel 105*b* that may support the roll 105*a* of the filler material 105.

In other example embodiments, the filler material 105 is a block of material, an extruded material, or a material that is in a shape other than a flat sheet.

Figure 2B:
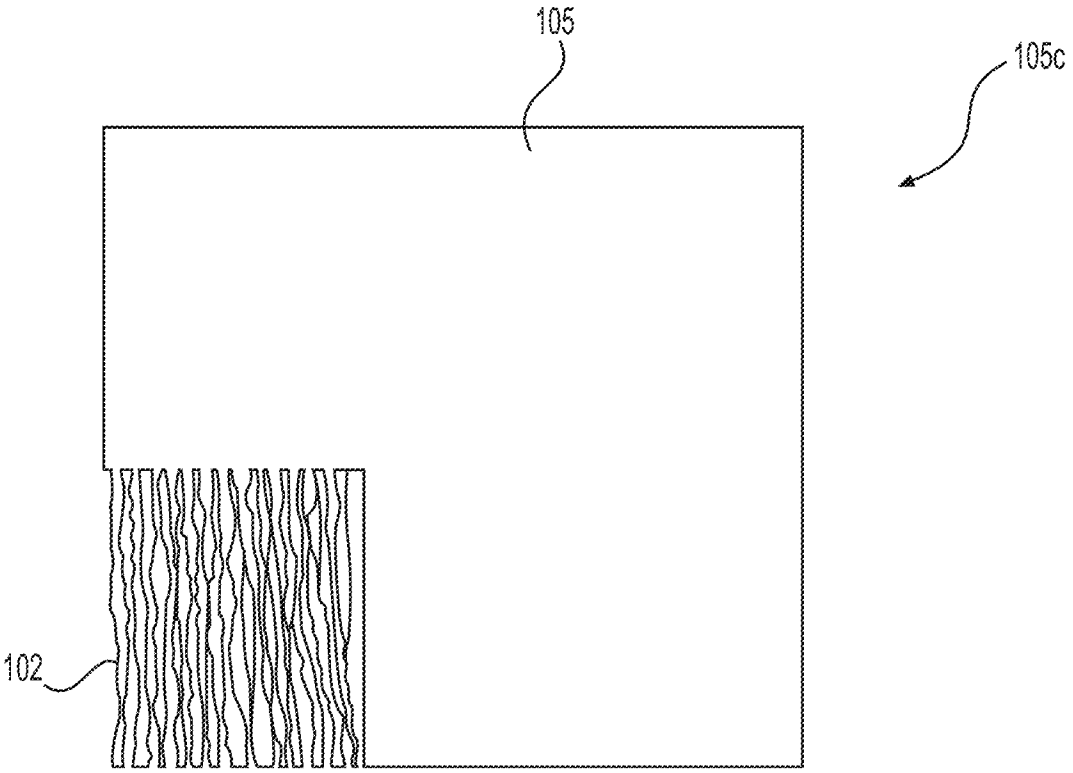
FIG. 2B is an illustration of a sheet of filler material being shredded into strands, in accordance with an example embodiment.

FIG. 2B is an illustration of a sheet 105*c* of the filler material 105, in accordance with an example embodiment. The sheet 105*c* may remain attached to a roll 105*a* during further processing of the filler material 105, or the sheet 105*c* may be cut from the roll 105*a*. Optionally, the sheet 105*c* of filler material 105 is formed and stored as the sheet 105*c*, such that the sheet 105*c* is not part of a roll 105*a*. In another embodiment, the filler material 105 may be formed and processed as a block of material, or another shape of the filler material 105, such that the filler material 105 is not in the form of the sheet 105*c*.

In an example embodiment, the filler material 105 is shredded into the strands 102. The strands 102 are combined to form the matrix 100 (FIG. 1). In an example embodiment, the filler material 105 has an initial sheet thickness of about 100 micrometers and a density of about 87 g/cm$^2$, prior to being cut or shredded into the strands 102. In an example embodiment, the sheet 105*c* of filler material 105 is porous, with a pore size that is about 10-12 micrometers, or about 11 micrometers. In an example embodiment, the strands 102 of the filler material 105 have a width of about 1-3 mm, with the understanding that the thickness of the strands 102 may correspond to the sheet 105*c* thickness of the filler material 105 in the event the strands 102 are formed by starting with a sheet 105*c* of the filler material 105. The filler material 105 can be considered a 'functional filler material' from the standpoint that it can include flavoring and/or nicotine, as described herein. The ranges of values in these example embodiments are not limiting and may be below or above these ranges.

It should be understood that the strands 102 may be formed via other processes, other than shredding. For instance, cutting, dicing, or other processes may be used to form the strands 102. In another embodiment, the strands 102 are formed via extrusion, such that the filler material 105 is not necessarily in a sheet-like form, prior to the formation of the strands 102. In another embodiment, as discussed above, the filler material 105 is folded or bunched together to form the matrix 100, where the folded and/or bunched together filler material 105 may or may not also be perforated, either before or after forming the matrix 100. In yet another embodiment, the filler material 105 may be processed so that shredded and/or cut strands 102 of the filler material 105 are combined with folded and/or bunched together filler material 105 that is not cut and/or shredded, in order to form the matrix 100.

Filler Material: Non-Tobacco Cellulose Example Embodiments

In an example embodiment, the filler material 105 is a non-tobacco cellulose. In particular, the non-tobacco cellulose is cast or made into the filler material 105, where the filler material 105 may be in the form of the sheet-like (paper-like) layer 105*c* that may or may not be rolled. In an example embodiment, the cellulose is a water-insoluble organic polymer material that is made from plant material, plant-based material, plant cell walls, vegetable fibers, cotton, polysaccharide, chains of glucose units (monomers), cellulose acetate, combinations of these materials, sub-combinations of these materials, etc. In another embodiment, the cellulose is partially water-soluble and made from the same materials, or combinations, or sub-combinations of the materials, etc.

In an example embodiment, the filler material 105 is about 30% to 99% alpha-cellulose material made from plant material, about 0.01% to 2% ash and the remainder is hemicellulose. In an example embodiment, the hemicellulose is a plant based material that includes beta-cellulose, gamma-cellulose, biopolymers, or combinations, or sub-combinations, thereof. In some examples, the primary strength and water-insoluble properties of the filler material 105 may be derived from the content of alpha-cellulose within the filler material 105. In an example embodiment, the filler material 105 is more than 98% alpha-cellulose material made from plant material, about 0.01% to 2% ash and the remainder is hemicellulose—where this filler material 105 embodiment is water-insoluble. The ranges of values in these example embodiments are not limiting and may be below or above these ranges.

Filler Material: Tobacco Cellulose and Non-Tobacco Cellulose Example Embodiments In an example embodiment, the filler material 105 is a plant-based tobacco cellulose. In particular, the tobacco cellulose is cast or made into the filler material 105, where in an example embodiment the filler material 105 is in the form of a sheet-like (paper-like) layer 105*c* that may or may not be rolled 105*a*. In an example embodiment, the filler material 105 is a tobacco cellulose that may or may not include tobacco extract. In an example embodiment, the cellulose is a non-tobacco cellulose that includes a tobacco extract. In an example embodiment, the tobacco cellulose is a water-insoluble material, or alternatively a partially water-soluble material.

In an example embodiment, the filler material 105 is about 30% to 99% tobacco cellulose, about 0.01% to 2% ash and the remainder is hemicellulose. In another embodiment, the filler material 105 is more than 98% tobacco cellulose, and about 0.01% to 2% ash, and is water-insoluble. The ranges of values in these example embodiments are not limiting and may be below or above these ranges.

Flavoring According to Some Example Embodiments

In an example embodiment, flavoring, a flavorant, or a flavor system, is included in the filler material 105 and/or in the strands 102 of the matrix 100 in order to release an aroma and/or flavors during operation, including in some cases, upon heating and/or as an airflow passes through insert 104. In an example embodiment, the flavoring includes volatile tobacco flavor compounds. Flavoring may also include flavors besides tobacco, or in addition to tobacco flavoring. The flavoring may be a flavorant that is a natural flavorant or an artificial flavorant. For instance, a flavorant may include tobacco flavor, tobacco extract, menthol, wintergreen, peppermint, herb flavors, fruit flavors, nut flavors, liquor flavors, roasted, minty, savory, cinnamon, clove, and any other desired flavors, and combinations or sub-combinations thereof. In an example embodiment, the flavoring is added to the filler material 105, either before or after the filler material 105 is processed into a sheet-like material, or before or after the filler material 105 is shredded, or otherwise transformed, into the strands 102. In some example embodiments, this may be accomplished by dipping the filler material 105 and/or the strands 102 in the flavoring, dispersing the flavoring onto the filler material 105 and/or strands 102, or otherwise exposing the filler material 105 and/or strands 102 to the flavoring.

In an example embodiment, the flavoring is infused into the filler material 105 during an initial formation and/or processing of the filler material 105. In an example embodiment, the flavoring is also or alternatively infused into the filler material 105 after the initial formation and/or processing of the filler material 105 and/or strands 102. In another embodiment, the filler material 105 and/or strands 102 of the matrix 100 are left unflavored, such that flavoring is not included in the matrix 100.

In an example embodiment, a flavoring system is included in a reservoir 106 in proximity to the matrix 100, where the reservoir 106 is in fluid communication with the matrix 100, as described below in relation to examples described in FIGS. 5-6 and 8. The flavoring system can be in lieu of, or in addition to, a flavoring system that is infused within the strands 102 of the matrix 100.

Flavoring: Non-Tobacco Flavoring According to Some Example Embodiments

In addition to the examples disclosed above, in an example embodiment the flavoring/flavorant added to either the non-tobacco cellulose filler material 105 and/or the tobacco extract filler material 105, or the strands made from the filler material 105, can include a 'tobacco flavoring' that is not tobacco. That is to say, this flavoring is not a tobacco extract, it is not derived from tobacco, and does not include any tobacco material in any form—and yet, this aromatic flavoring sensorially mimics (e.g., smells and/or tastes like) tobacco.

Nicotine for Some Example Embodiments

In an example embodiment, nicotine is included in the strands 102 of the matrix 100. In one example embodiment, about 1-15 mg of nicotine is included in the matrix 100. Less or more nicotine may be used in other example embodiments. In an example embodiment, the matrix 100 contains enough nicotine that the initial (first) five "draws" of the matrix 100 includes about 100-500 micrograms of nicotine per draw. A "draw" is defined to be about 55 $cm^3$ of fluid that flows for a period between about 3-5 seconds. Less or more nicotine may be used in the matrix in other example embodiments to obtain other results.

In an example embodiment, nicotine is added to the filler material 105, either before or after the filler material 105 is processed into a sheet-like layer, or before or after the filler material 105 is shredded, or otherwise transformed, into the strands 102. In some example embodiments, this may be accomplished by dipping the filler material 105 and/or the strands 102 in the nicotine, dispersing the nicotine onto the filler material 105 and/or strands 102, or otherwise exposing the filler material 105 and/or strands 102 to the nicotine.

In an example embodiment, the nicotine is infused into the filler material 105 during an initial formation and/or processing of the filler material 105. In an example embodiment, the nicotine is also or alternatively infused into the filler material 105 after the initial formation and/or processing of the filler material 105 and/or strands 102. In another embodiment, nicotine is not included in the filler material 105, the strands 102 or the matrix 100.

In an example embodiment, nicotine may be included in a reservoir 106 in proximity to the matrix 100, where the reservoir 106 is in fluid communication with the matrix 100, as described below in relation to examples described in FIGS. 5-6 and 8. This reserve of nicotine can be in lieu of, or in addition to, nicotine that is infused within the strands 102 of the matrix 100.

Example Embodiments with Pre-Vapor Formulation

In an example embodiment, the flavoring and/or nicotine is included in a pre-vapor formulation, and then the pre-vapor formulation with the flavoring and/or nicotine is infused into the filler material 105. In another embodiment, the pre-vapor formulation is infused into the filler material 105 separately from the flavoring and/or nicotine.

In an example embodiment, the pre-vapor formulation is a liquid, solid and/or gel formulation including, but not limited to, water, beads, solvents, active ingredients, ethanol, plant extracts, natural or artificial flavors, and/or at least one vapor former such as glycerin and propylene glycol.

In an example embodiment, the at least one vapor former of the pre-vapor formulation includes diols (such as propylene glycol and/or 1,3-propanediol), glycerin and combinations, or sub-combinations, thereof. Various amounts of vapor former may be used. For example, in some example embodiments, the at least one vapor former is included in an amount ranging from about 20% by weight based on the weight of the pre-vapor formulation to about 90% by weight based on the weight of the pre-vapor formulation (for example, the vapor former is in the range of about 50% to about 80%, or about 55% to 75%, or about 60% to 70%), etc. As another example, in an example embodiment, the pre-vapor formulation includes a weight ratio of the diol to glycerin that ranges from about 1:4 to 4:1, where the diol is propylene glycol, or 1,3-propanediol, or combinations thereof. In an example embodiment, this ratio is about 3:2. Other amounts or ranges may be used.

In an example embodiment, the pre-vapor formulation also includes water. Various amounts of water may be used. For example, in some example embodiments, water may be included in an amount ranging from about 5% by weight based on the weight of the pre-vapor formulation to about 40% by weight based on the weight of the pre-vapor formulation, or in an amount ranging from about 10% by weight based on the weight of the pre-vapor formulation to about 15% by weight based on the weight of the pre-vapor formulation. Other amounts or percentages may be used. For example, in an example embodiment, the remaining portion of the pre-vapor formulation that is not water (and nicotine and/or flavoring compounds), is the vapor former (described above), where the vapor former is between 30% by weight and 70% by weight propylene glycol, and the balance of the vapor former is glycerin. Other amounts or percentages may be used.

Figure 3:
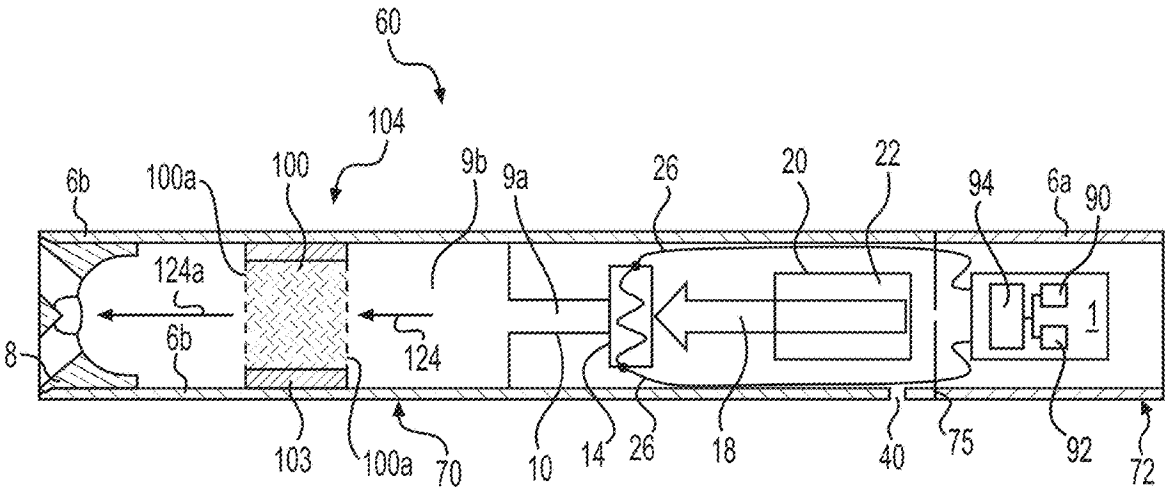
FIG. 3 is a diagram of a device with an insert containing a matrix, in accordance with an example embodiment.

In an example embodiment, the pre-vapor formulation includes at least one flavorant in an amount ranging from about 0.2% to about 15% by weight (for instance, the flavorant may be in the range of about 1% to 12%, or about 2% to 10%, or about 5% to 8%). In an example embodiment, the pre-vapor formulation includes nicotine in an amount ranging from about 1% by weight to about 10% by weight (for instance, the nicotine is in the range of about 2% to 9%, or about 2% to 8%, or about 2% to 6%). In an example embodiment, the portion of the pre-vapor formulation that is not nicotine and/or a flavorant, includes 10-15% by weight water, where the remaining portion of the non-nicotine and non-flavorant portion of the formulation is a mixture of propylene glycol and a vapor former where the mixture is in a ratio that ranges between about 60:40 and 40:60 by weight. Other combinations, amounts or ranges may be used Device with Insert According to Some Example Embodiments FIG. 3 is a diagram of a device 60 with an insert 104 containing a matrix 100, in accordance with an example embodiment. In an example embodiment, the device 60 is an e-vaping device. In an example embodiment, the device 60 includes a first section 70 that is a cartridge. In an example embodiment, the first section 70 includes a reservoir 20 that contains a pre-vapor formulation 22 (such as the pre-vapor formulation described above). In an example embodiment, the reservoir 20 is in fluid communication with a heater 14 in the first section 70. In particular, a structural transport 18 may allow the pre-vapor formulation 22 to travel from the reservoir 20 to the heater 14. In an example embodiment, the structural transport 18 includes a physical structure at least partially utilizing capillary action, gravity, piezoelectric power, solar power, absorption, osmosis, a pressure gradient, applied pressure, other modes of fluid transfer, or combinations/sub-combinations thereof, to allow, cause and/or force the pre-vapor formulation 22 to travel from the reservoir 20 to the heater 14.

In an example embodiment, the device 60 includes a second section 72. In an example embodiment, the second section 72 is a power section. The second section 72 may be connectable to the first section 70. In an example embodiment, the second section 72 includes a control system 1. In an example embodiment, the control system 1 includes a controller 90 that is operationally connected to a power supply 94 and at least one sensor 92, such as a pressure sensor and/or a temperature sensor. The sensor(s) 92 can be located in the first section 70 or the second section 72. In an example embodiment, the at least one sensor 92 is operationally constructed to measure one or more of the following: a resistance of the heater 14, a temperature of the heater 14 and/or a draw of airflow through the device 60. In an example embodiment, the controller 90 of the control system 1 receives an input signal, or signals, from sensor(s) 92, and the controller 90 controls operations of the device 60, including supplying an electrical current from the power supply 94 to the heater 14 to vaporize the pre-vapor formulation based at least in part on the signal(s) from the sensor(s) 92. In an example embodiment, the control system 1 is operationally and electrically connected to the heater 14 via electrical leads 26 that allow the control system 1 to selectively send the electrical current to the heater 14. Both sections 70/72 can include the respective housing 6*b*/6*a*, where the sections may be connected by a connecting structure 75. The vapor thus formed is evacuated out of the device 60 via a mouth-end insert 8. In an example embodiment, one or more air inlets 40 are included in the housing 6*a* and/or housing 6*b* (either in the first section 70, or a second section 72 of the device 60). The housings 6*a*/6*b* in FIG. 3 may be the same or different shapes, such as for example cylindrical, square, rectangular, triangular, polygonal, curved, irregular, etc. In an example embodiment, the air inlet(s) 40 are used to establish an airflow path through the device 60 that may exit the mouth-end insert 8, where the heater 14 and insert 104 are in, or otherwise exposed to, the airflow path. In an example embodiment, the control system 1 is in fluid communication with the airflow path.

In an example embodiment, the first section 70 includes the insert 104. In the first section 70, the insert 104 is positioned to cause the matrix 100 to reside in or near a path of vapor flow 124 that is defined by the device 60. Vapor 124 leaving the heater 14 passes across the matrix 100, or directly through the matrix 100, in order to create a downstream vapor 124*a* that includes entrained flavoring, nicotine and/or the pre-vapor formulation from the matrix 100, as described below in more detail. Vapor, aerosol and dispersion are used interchangeably and are meant to cover any matter generated or output by the devices and/or elements of the devices claimed and equivalents thereof.

In an example embodiment, the insert 104 is sized so that sides of the containing structure 103 are pressure-fitted into an outer air passage 9*a*, or a second (enlarged) outer air passage 9*b* (notice that FIG. 3 shows the insert 104 only in the second outer air passage 9*b*), or both in the event the device 60 includes more than one insert 104. In an example embodiment with an insert 104 without a containing structure 103, the insert 104 can be sized so that a matrix 100 is pressure-fitted into an outer air passage 9*a*, 9*b* or both. The insert 104 is to be positioned downstream of a heater 14, and may be located near a mouth-end insert 8 for the device 60. Alternatively to pressure-fitting, the insert 104 may instead be held in place via an adhesive, set screws, a snap-fit connecting structure, or any other structure necessary to hold the insert 104 in place within the first section 70.

In the embodiment shown in FIG. 3, one or both ends 100*a* of the matrix 100 include a containing structure 103 for the insert 104 that is a screen and/or a porous material, as described above, in order to allow for airflow through the matrix 100 of the insert 104. Meanwhile, the containing structure 103 on the sides 100*b* of the matrix 100 may be a soft, hard or solid material, as described above, in order to allow the insert 104 to firmly grip and/or be adhered and/or pressure fitted to the housing 6*b* and/or inner passage 10 of the first section 70 and be held in place.

In an example embodiment, the insert 104 is affixed within the first section 70. In this embodiment, the first section 70 may be disposable. In another embodiment, the insert 104 is temporarily held within the first section 70, such that the insert 104 is removable and replaceable prior to the useful end-life of the first section 70, allowing the first section 70 to be non-disposable and/or be re-used with replacement inserts 104. In an example embodiment, the insert 104 may allow for the flavoring system, the nicotine and/or the pre-vapor formulation to be added or recharged within the insert 104 so that the removed insert 104 can then be reinstalled into the first section 70. In another embodiment, the insert 104 is removable and replaceable with a new insert 104 and, where the insert 104 may be disposable. Or, a containing structure 103 of the insert 104 may be removable, or remain affixed within the first section 70, where only the matrix 100 may be removed and replaced from the containing structure 103, such that the containing structure 103 is reusable and the matrix 100 is replaceable. In yet another embodiment, rather than the insert 104 and/or matrix 100 being removable and replaceable, or in addition to the insert 104 and/or matrix 100 being removable and replaceable, the first section 70 may allow for access to the matrix 100 and/or insert 104 in order to allow the flavoring system, nicotine and/or the pre-vapor formulation to be added or recharged within the matrix 100 and/or insert 104.

In an example embodiment, the reservoir 20 contains a supply of the pre-vapor formulation 22 that is heated by heater 14 to generate a vapor, where this pre-vapor formulation 22 supply is separate from a pre-vapor formulation that may be infused into the filler material 105 of the matrix 100. In an example embodiment, the pre-vapor formulation 22 includes flavoring and/or nicotine that is the same as the flavoring and/or nicotine described above, or alternatively that is different than the flavoring and/or nicotine described above, or alternatively the pre-vapor formulation 22 may instead not contain flavoring and/or nicotine. In an example embodiment, the flavoring and/or nicotine may be provided by flavoring and/or nicotine in matrix 100, as vapor generated by heater 14 flows through the matrix 100.

In an example embodiment, the heater 14 is in communication with the inner passage 10. In an example embodiment, the inner passage 10 is cylindrical in shape, though the inner passage 10 may also be a different shape and may have, for instance, a cross-sectional profile that is square, rectangular, triangular, polygonal, irregular, etc. In an example embodiment, the heater 14 is constructed of an iron-aluminide (e.g., FeAl or $Fe_3Al$).

As stated above, the heater 14 is upstream of the insert 104. The heater 14 is configured to heat the pre-vapor formulation 22 in order to produce a vapor 124, where the vapor 124 is warmed to an extent that the vapor 124 can at least partially extract (e.g., vaporize, elute, etc.) the flavoring, nicotine and/or ingredients of a pre-vapor formulation in the matrix 100, as the vapor 124 flows across and/or through the matrix 100 to produce the downstream vapor 124*a* that exits the insert 104. In an example embodiment, the heater 14 is a distance apart from the matrix 100 and/or insert 104, such that convection indirectly heats the matrix 100, as well. In an example embodiment, the heater 14 is in a channel with a smaller diameter and/or smaller cross-sectional area for airflow (e.g., inner passage 10), relative to the channel (air passage 9*b*) containing the insert 104. In an alternative embodiment, the channel containing the heater 14 and the insert 104 is a channel with a same diameter and/or a same airflow cross-sectional area.

In an embodiment, the heater 14 is in the form of a wire coil, a planar body, a ceramic body, a single wire, a cage of resistive wire, or any other suitable form that is configured to vaporize the pre-vapor formulation 22. In at least one example embodiment, the heater 14 is formed of any suitable electrically resistive material or materials. In another example embodiment, the heater 14 is a ceramic heater having an electrically resistive layer on an outside surface thereof.

In an example embodiment, the mouth-end insert 8 of the first section 70 is permanently affixed on an end of the first section 70, or alternatively the mouth-end insert 8 is removable. In an example embodiment where the mouth-end insert 8 is removable, this may allow an insert 104 to also be replaceable and/or refillable from an open end of the housing 6*b* provided when the mouth-end insert 8 has been removed.

A position of the heater 14 is not limited to the position shown in FIG. 3, nor is the precise position of the insert 104 limited to the position shown in FIG. 3. For example, the heater 14 may be positioned at a downstream end of the outer air passage 9*a*, such that the heater 14 may be closer to the matrix 100 of the insert 104. In an example embodiment, the heater 14 may protrude out of the outer air passage 9*a* and into the second outer air passage 9*b*. Meanwhile, the insert 104 may be set closer to the mouth-end insert 8, or closer to an outer air passage 9*a*. Furthermore, the insert 104 may be positioned in the narrower outer air passage 9*a*, either in lieu of the insert 104 being positioned in the second outer air passage 9*b*, or in addition to an insert 104 also being positioned in the second air passage 9*b*. In an example embodiment, more than one insert 104 is included in the first section 70. In some embodiments, only an outer air passage 9*b*, without an air passage 9*a*, may be included, with the heater 14 and the insert 104 in fluid communication via the air passage 9*b*.

In some examples, the heater 14 warms the matrix 100 within the insert 104, but the heater 14 does not burn and/or combust the matrix 100. Thus, the matrix 100 in some example embodiments is non-combustible.

In an example embodiment, the power supply 94 is a battery, such as a lithium ion battery. The battery may be a Lithium-ion battery or one of its variants, for example a Lithium-ion polymer battery. Alternatively, the battery is a Nickel-metal hydride battery, a Nickel cadmium battery, a Lithium-manganese battery, a Lithium-cobalt battery, a fuel cell or a solar cell. Any other power sources or battery technology may be used. In an example embodiment, second section 72 may be usable until the energy in the power supply 94 of the control system 1 is depleted and/or lowered below a certain threshold. Alternatively, the power supply 94 of the control system 1 may be rechargeable and reusable, and may include circuitry allowing the battery to be chargeable by an external charging device, or may be rechargeable via solar power. In some examples, the circuitry of the control system 1, when charged, may provide power for a desired (or alternatively, a determined) number of draws, until the energy in power supply 94 is depleted, and/or until the energy in power supply 94 is lowered below a certain threshold, after which the circuitry must be re-connected to an external charging device.

In an example embodiment, the first section 70 is connectable to the second section 72 via the connecting structure 75. In an embodiment, the connecting structure 75 can include a threaded connection, a friction fitting, a snap fitting, an adhesive, a removable and/or insertable pin, a magnetic connection, or any other suitable structure that may be used to join the sections 70/72 to each other. Optionally, the second section 72 is permanently connected to the first section 70, such that the second section 72 may be an integral section of the first section 70. In an example embodiment, the device 60 does not have separate sections 70/72, such that the device 60 is one singular section. Or, alternatively, the device 60 may include more than two sections. In an example embodiment, section 70, or the sections 70/72 collectively, define an airflow path for the device 60, where the heater 14 and the insert 104 are in communication with this airflow path.

Example Operation of Some Example Embodiments:

In some examples, airflow through the device 60 may be caused by air being drawn into the air inlet(s) 40 and through the first section 70. In outer air passage 9*a*, the airflow may become entrained (eluted) by vapor that may be produced by the heater 14 heating a pre-vapor formulation 22. In the second outer air passage 9*b*, the vapor 124 may pass through the matrix 100 of the insert 104 in order to allow the vapor to become entrained by added flavoring and/or nicotine from the matrix 100, prior to the downstream vapor 124*a* exiting the device 60. As noted, in some embodiments, there may be only one air passage 9*b*, and vapor produced by the heater 14 will go directly to said air passage 9*b*, where the vapor 124 may pass through the matrix 100 of the insert 104 in order to allow the vapor to become entrained by added flavoring and/or nicotine from the matrix 100, prior to the downstream vapor 124*a* exiting the device 60.

In an example embodiment, an airflow through the device 60 activates the device 60. The sensor(s) 92 may be configured to generate an output indicative of an airflow, a magnitude of an airflow, and/or a direction of an airflow, where the controller 90 may receive the output from the sensor(s) 92 and determine if the following internal conditions exist: (1) an airflow exists, if a direction of the airflow indicates a draw of airflow through the device 60 (versus blowing air through the device 60), and/or (2) a magnitude of the airflow exceeds a threshold value. If one or more of these internal conditions of the device 60 are met, the controller 90 electrically connects the power supply 94 to the heater 14, thereby activating the heater 14. In some example embodiments, only one condition may be sufficient to activate the heater, while in other examples, two conditions or all conditions may have to be met before activating the heater.

In an example embodiment, the sensor(s) 92 generate a variable output signal that is in at least a partial correlation with a magnitude of a pressure drop sensed by the sensor(s) 92. In an example embodiment, the controller 90 may send a variable electrical current to the heater 14 based on the variable output signal from the sensor(s) 92. The sensor(s) 92 may include a sensor as disclosed in "Electronic Smoke Apparatus," U.S. application Ser. No. 14/793,453, filed on Jul. 7, 2015, or a sensor as disclosed in "Electronic Smoke," U.S. Pat. No. 9,072,321, issued on Jul. 7, 2015, each of which are hereby incorporated by reference in their entirety into this document. Other type of sensors to detect an airflow may be used.

Figure 4:
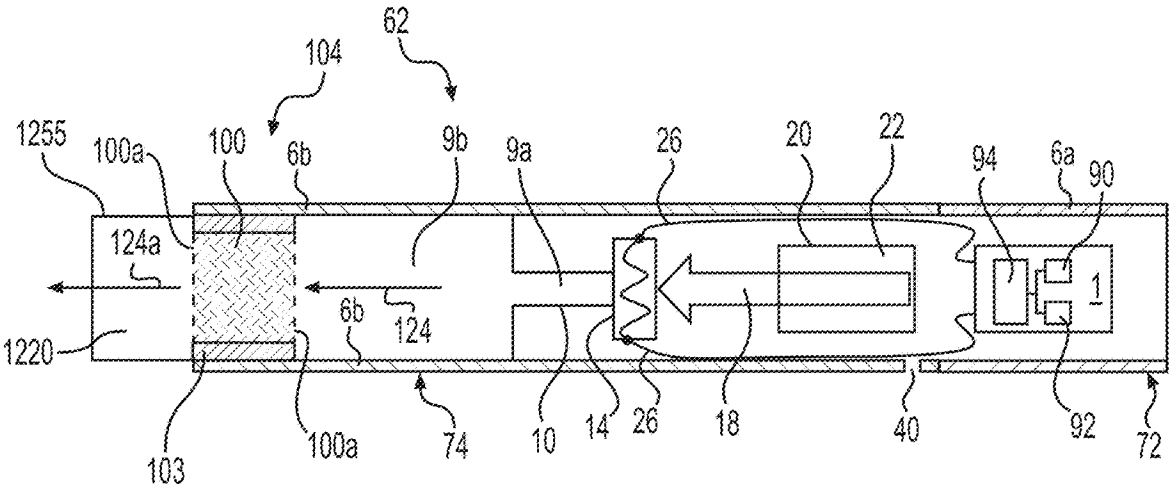
FIG. 4 is a diagram of a device with an insert containing a matrix, in accordance with an example embodiment.

FIG. 4 is a diagram of a device 62 with an insert 104 containing a matrix 100, in accordance with an example embodiment. Reference numbers in common with FIG. 3 are not described again here, for brevity sake. In an example embodiment, insert 104 includes a filter 1220 that is a non-consumable filter (does not include a consumable substance), and/or that may for instance be a cellulose acetate (CA) filter. A portion of the containing structure 103 and/or insert 104 may be connected to the filter 1220 via any known means and/or structure, including but not limited to an adhesive, a covering or the containing structure 103 (e.g., additional tipping paper covering filter 1220 and the insert 104, or the containing structure 103 being extended to cover both the insert 104 and filter 1220, etc.), prongs, pins, etc. The filter 1220 may be circumscribed at least in part by its own covering 1255, where the covering 1255 may be a foil, tipping paper, or other material that allows the downstream vapor 124*a* to pass through the filter 1220, at least through an upstream and downstream end of the filter. As noted, in some examples, covering 1255 may cover filter 1220, containing structure 103 may cover matrix 100, and both may be then covered by an additional covering connecting the two, or, covering 1255 and containing structure 103 may form part of the same cover that covers both filter 1220 and matrix 100. In another example, containing structure 103 may cover matrix 100, and a separate covering may cover the filter 1220 and the containing structure 103. Other variations may be used that connect filter 1220 and matrix 100. In an example embodiment, the insert 104 and filter 1220 may be removed from the device 62 as one element, and a replacement insert 104 with filter 1220 may be inserted into the device 62. In an example embodiment, the filter 1220 takes the place of a mouth-end insert (such as the mouth-end insert 8 of FIG. 3), such that a separate mouth-end insert is not present.

In an example embodiment, dilution air (not shown) is introduced into the flow of the downstream vapor 124*a* prior to the downstream vapor 124*a* exiting the device 62. This may be accomplished, for example, by perforating sides of the covering 1255 of the filter 1220.

Figure 5:
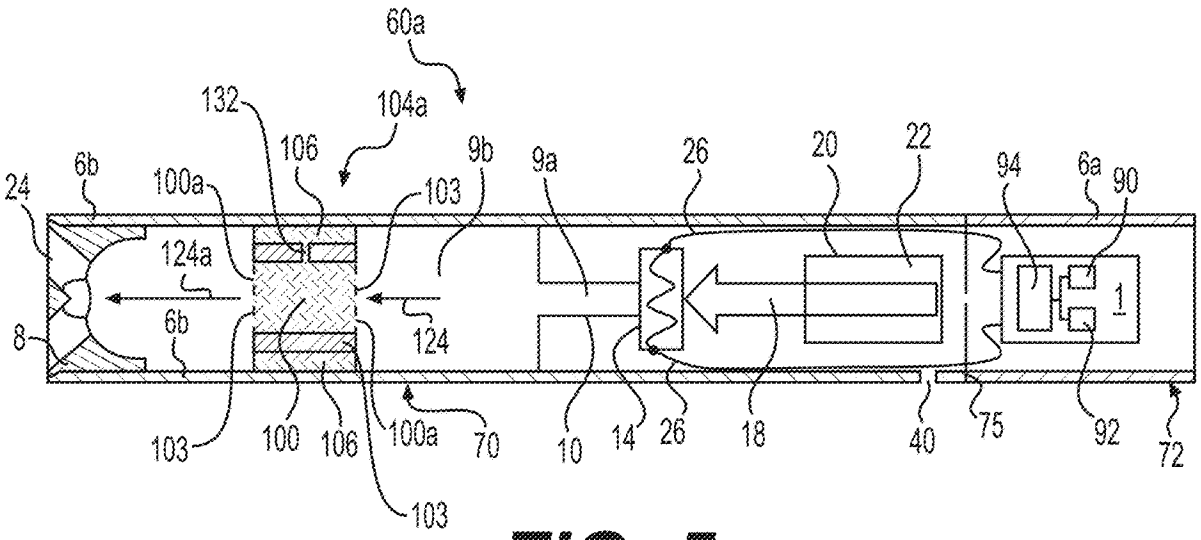
FIG. 5 is a diagram of a device with an insert containing the matrix and a reservoir, in accordance with an example embodiment.

FIG. 5 is a diagram of a device 60*a* with an insert 104*a* containing a matrix 100 and a reservoir 106, in accordance with an example embodiment. Reference numbers in common with the previous embodiments are not described again here, for brevity sake. In an example embodiment, the reservoir 106 contains nicotine, a flavorant and/or a pre-vapor formulation. The reservoir 106 is in fluid communication with the matrix 100 of the insert 104*a*. In particular, a wick system 132, such as a wick, a capillary tube, a narrow channel, or other structure capable of communicating nicotine, a flavorant and/or a pre-vapor formulation from the reservoir 106 to the matrix 100, is used to provide nicotine, flavorant and/or pre-vapor formulation to the matrix 100 during operation of the device 60*a*, and/or is used to replenish the nicotine, flavorant and/or pre-vapor formulation within the matrix 100 during operation of the device 60*a*.

In an example embodiment, the insert 104*a* is removable in order to allow the reservoir 106 to be re-filled after being depleted. In another embodiment, the reservoir 106 is re-Tillable without the insert 104*a* and/or the reservoir 106 being removed from the first section 70. In another embodiment, the insert 104*a* is disposable, such that the insert 104*a* may be disposed following depletion of the matrix 100 and/or reservoir 106.

In another embodiment, rather than a separate dedicated reservoir 106 being in fluid communication with the matrix 100, the reservoir 20 in first section 70 is in fluid communication with the matrix 100. That is to say, the reservoir 20 is in fluid communication with both the matrix 100 and the heater 14.

Figure 6:
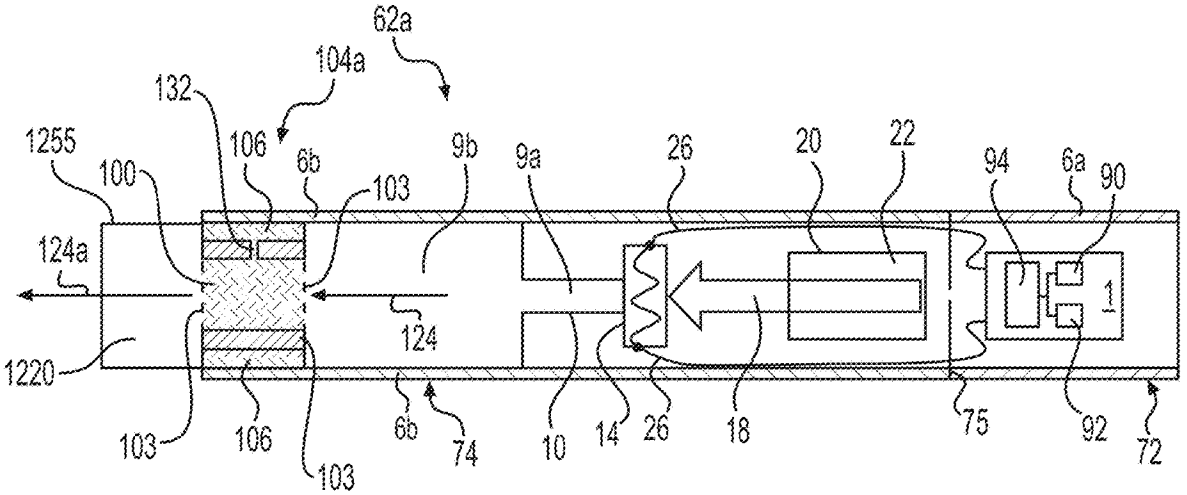
FIG. 6 is a diagram of a device with an insert containing the matrix and a reservoir, in accordance with an example embodiment.

FIG. 6 is a diagram of a device 62*a* with a insert 104*a* containing a matrix 100 and a reservoir 106, in accordance with an example embodiment. Reference numbers in common with the previous embodiments are not described again here, for brevity sake. This embodiment includes a same insert 104*a* as shown and described in relation to the device 60*a* of FIG. 5, though this insert 104*a* also includes the filter 1220 that may be an integral element of the insert 104*a* and/or otherwise connected to insert 104*a*.

Figure 7:
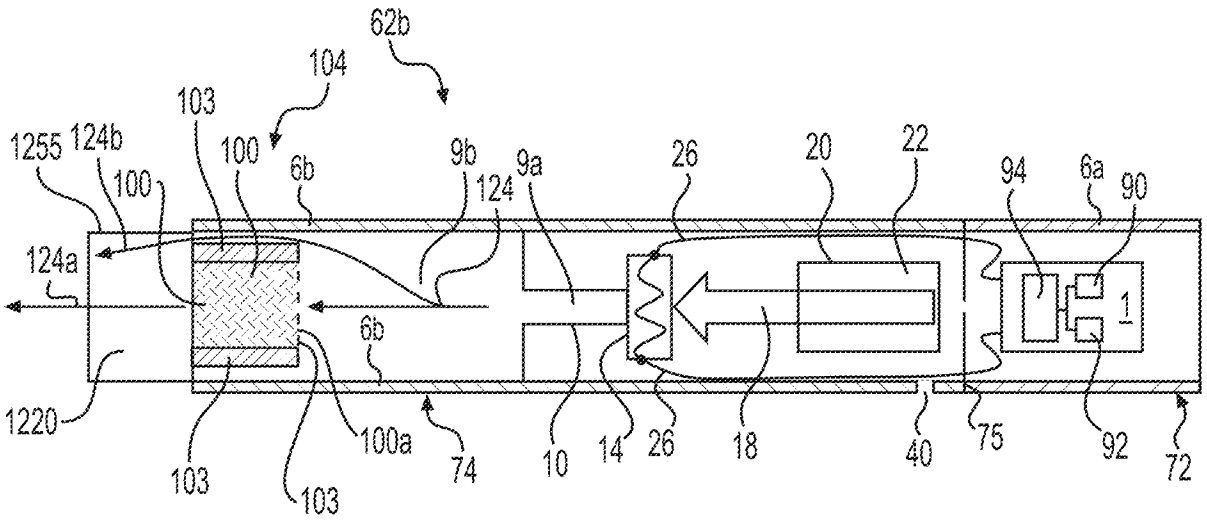
FIG. 7 is a diagram of a device with an insert containing a matrix, including a bypass airflow, in accordance with an example embodiment.

FIG. 7 is a diagram of a device 62*b* with a insert 104 containing the matrix 100, including a bypass airflow, in accordance with an example embodiment. Reference numbers in common with the previous embodiments are not described again here, for brevity sake. In an example embodiment, a gap exists between the matrix 100 and/or containing structure 103 and an inner surface of the housing 6*b* to allow for bypass air 124*b* to pass across and/or fully circumvent the matrix 100. In an example embodiment, the containing structure 103 include holes or penetrations along the sides 100*b* of the matrix 100 to allow the bypass airflow 124*b* to contact at least a portion of the matrix 100. In another embodiment, the containing structure 103 is porous, mesh, or made from other materials (as described above), along the sides 100*b* of the matrix 100, to more fully allow the bypass airflow 124*b* to contact the matrix 100. In another embodiment, the device 62*b* and/or first section 70 may include tubing or other structure, other than or in addition to a gap between the insert 104 and the housing 6*b*, in order to provide the bypass airflow 124*b* across and/or around the matrix 100. It should be understood that, in the event the device 62*b* includes the bypass airflow 124*b*, this bypass airflow 124*b* may include an entrained vapor, just as the downstream vapor 124*a* passing through the matrix 100 also includes a vapor, if the bypass airflow 124*b* passes across an exposed surface of the matrix 100.

Figure 8:
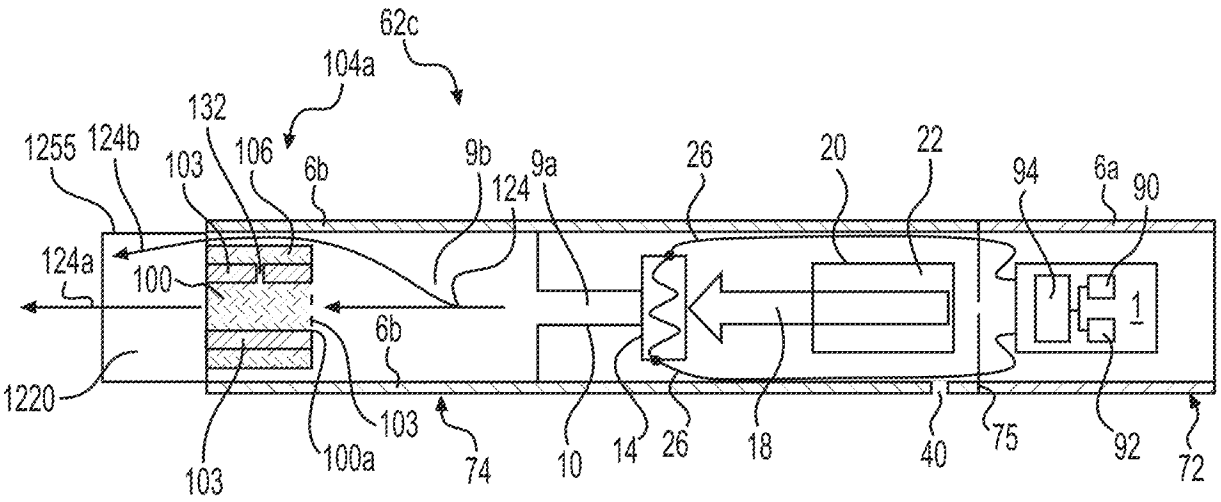
FIG. 8 is a diagram of a device with an insert containing the matrix and a reservoir, including a bypass airflow, in accordance with an example embodiment.

FIG. 8 is a diagram of a device 62*c* with an insert 104*a* containing a matrix 100 and a reservoir 106, including the bypass airflow 124*b*, in accordance with an example embodiment. Reference numbers in common with the previous embodiments are not described again here, for brevity sake. In this embodiment, the first section 70 includes an insert 104*a* that is the same as the insert 104*a* of the device 62*a* shown and described in relation to FIG. 6, though this insert 104*a* includes a gap between the sides of the containing structure 103 and the inner surface of the housing 6*b* to allow for the bypass airflow 124*b* to circumvent the matrix 100.

Insert Examples According to Example Embodiments

Figure 9A:
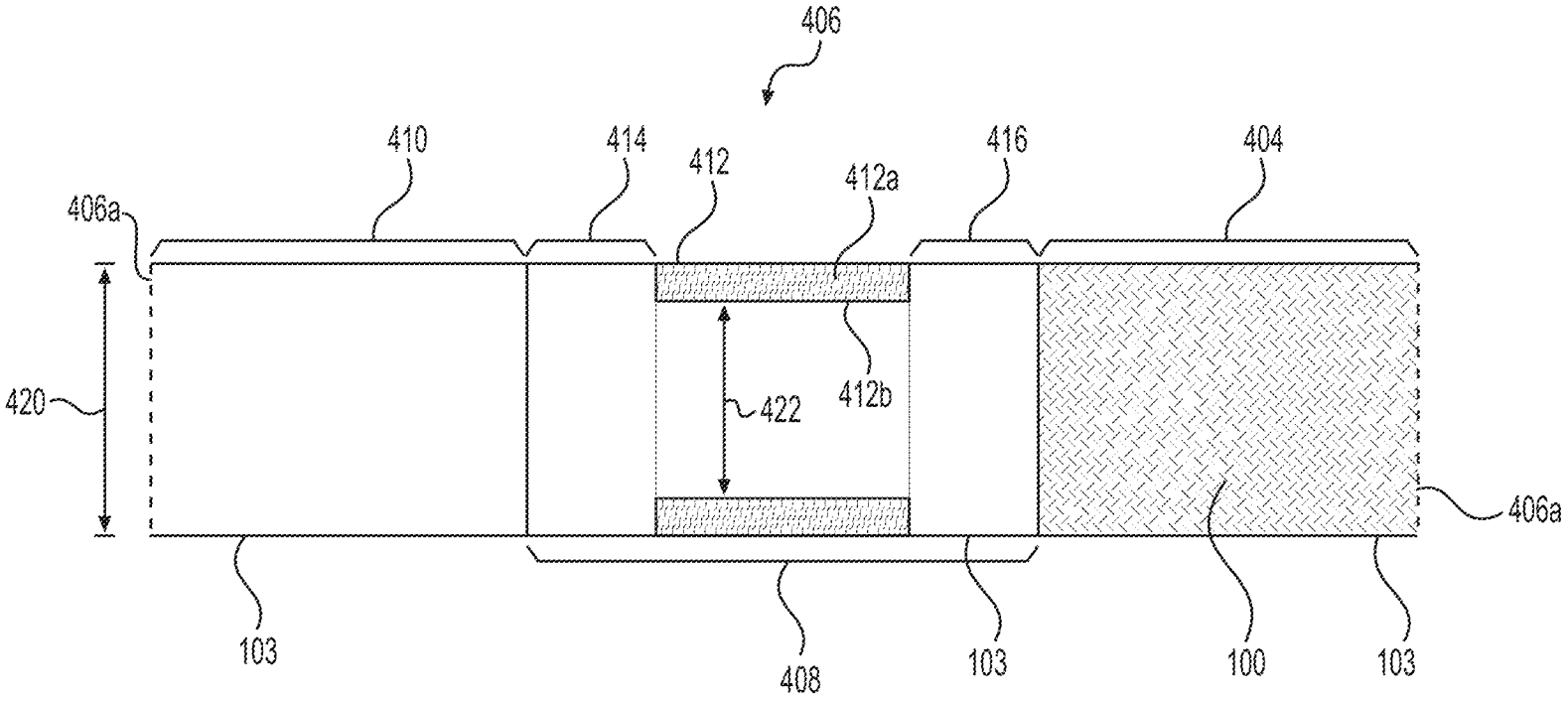
FIG. 9A is an illustration of a side-view of a matrix in an insert that is in the form of an insertable rod, in accordance with an example embodiment.

FIG. 9A is an illustration of a side-view of a matrix 100 in an insert 406 that is in the form of an insertable rod, in accordance with an example embodiment. In an example embodiment, the insert 406 includes at least three sections: a proximal end section 404 that includes the matrix 100, a middle section 408, and a distal end section that is a filter 410. The filter 410 in some example embodiments is a non-consumable filter that does not include a consumable substance (e.g., the 410 is devoid of a consumable substance). The insert 406 has a "plug-space-plug" configuration, from the standpoint that the middle section 408 is largely a section of open (void) space (e.g., wrapped by a tipping paper that can also wrap the other sections). In some examples, the middle section 408 may include a flow restrictor 412. The flow restrictor 412 may be in the form of a tube with walls 412*a*, where an internal surface 412*b* of the tube walls forms a restricted flow channel with a diameter 422. In an example embodiment, the middle section 408 defines open spaces 414/416 that bracket the flow restrictor 412, such that the flow restrictor 412 does not reach the ends of the middle section 408. In some examples, the flow restrictor 412 may reach both ends of the middle section 408, or may reach one end but not both ends of the middle section 408. The reduced internal diameter 422 of a flow restrictor 412 reduces an airflow cross-sectional area through the flow restriction section 408 to control a RTD and an airflow through the insert 406. The filter 410 is a filter that may be, for instance, a cellulose acetate (CA) filter. In an example embodiment, the filter 410 (or other filters described in various embodiments) may also contain nicotine, flavorants, etc. In some embodiments, flavorant beads and/or crushable beads may be included in one or more of the sections. In an example embodiment, an airflow through the insert 406 flows in a direction that causes the airflow to enter and flow through the matrix 100, before passing through the middle section 408 and the filter 410. In some examples, an insert 406 may include less than three sections or more than two sections. For example, one example may include a filter section and a matrix section as has been described, or another example may include a section such as 408 and a matrix section, and in other examples more than three sections may be included with additional spaces, sections such as 408, filter sections and/or matrix sections.

In an example embodiment, an insert 406 includes a containing structure 103 that spans the length of the insert 406, by covering the outer surfaces of the matrix 100, the middle section 408 and the filter 410 and/or any other sections that may form part of the insert 406. In an example embodiment, the only wrapping around the matrix 100, middle section 408, filter section 410 and/or any other sections that may form part of the insert 406, is a containing structure 103 without any other wrapping around each of the sections that form part of insert 406 (i.e., the sections being wrapped only by and connected by a single wrapping such as containing structure 103). In an example embodiment, the containing structure 103 is made from tipping paper. In another embodiment, the containing structure is made from any of the materials described in conjunction with the containing structure 103, included in the embodiments described herein. In an example embodiment, ends 406*a* of the insert 406 are open (e.g., the containing structure 103 is only wrapped around insert 406 in a longitudinal direction such that the containing structure 103 does not exist on the ends 406*a* of the insert 406). In another embodiment, containing structure 103 exists on the ends 406*a* of the insert 406 made from any of the materials for containing structure 103 of the example embodiments described herein. One or more sections may also have their own cover, and then the various sections may be connected together, either by another covering or by other structure.

Dimensions and Performance in Some Example Embodiments

In an example embodiment, the diameter 420 of an insert 406 is about 7-10 mm, or about 8.6 mm. In an example embodiment, the internal (restricted) diameter 422 of a flow restrictor 412 is about 4-8 mm, or about 5 mm. In an example embodiment, a longitudinal length of an end section 404 with the matrix 100 is about 5-16 mm, or about 6 mm. In an example embodiment, a longitudinal length of a middle section 408 is about 12-25 mm, or about 12 mm. In an example embodiment, spaces 414/416 of a section 408 may each have a longitudinal length of about 4 mm. In an example embodiment, a longitudinal length of a filter 410 is about 6-9 mm, or about 6 mm. In an example embodiment, the RTD of the insert 406 is about 30 mm of water or less, or about 26 mm of water or less. In an example embodiment, an insert 406 has the following dimensions: an end section 404 with the matrix 100 has a longitudinal length of about 6 mm, restriction middle section 408 has a longitudinal length of about 12 mm with spaces 414/416 that are each about 4 mm long, and a filter 410 has a longitudinal length of about 6 mm—with a RTD of the insert 406 being about 26 mm of water or less. In some example embodiments, the void space within the flow restriction section 408, and a size of the internal diameter 422 of the flow restrictor 412, may help control an airflow rate and a RTD of the insert 406, wherein in some examples a lower RTD may generally allow a greater amount of flavor and/or nicotine to be imparted to the downstream vapor 124*a* exiting the insert 406 (see FIG. 10). The ranges of values in these example embodiments are not limiting and may be below or above these ranges.

Insert Examples According to other Example Embodiments

In an example embodiment, the insert 406 is disposable, such that the insert 406 may be discarded following a depletion of the consumable substance within matrix 100.

Figure 9B:
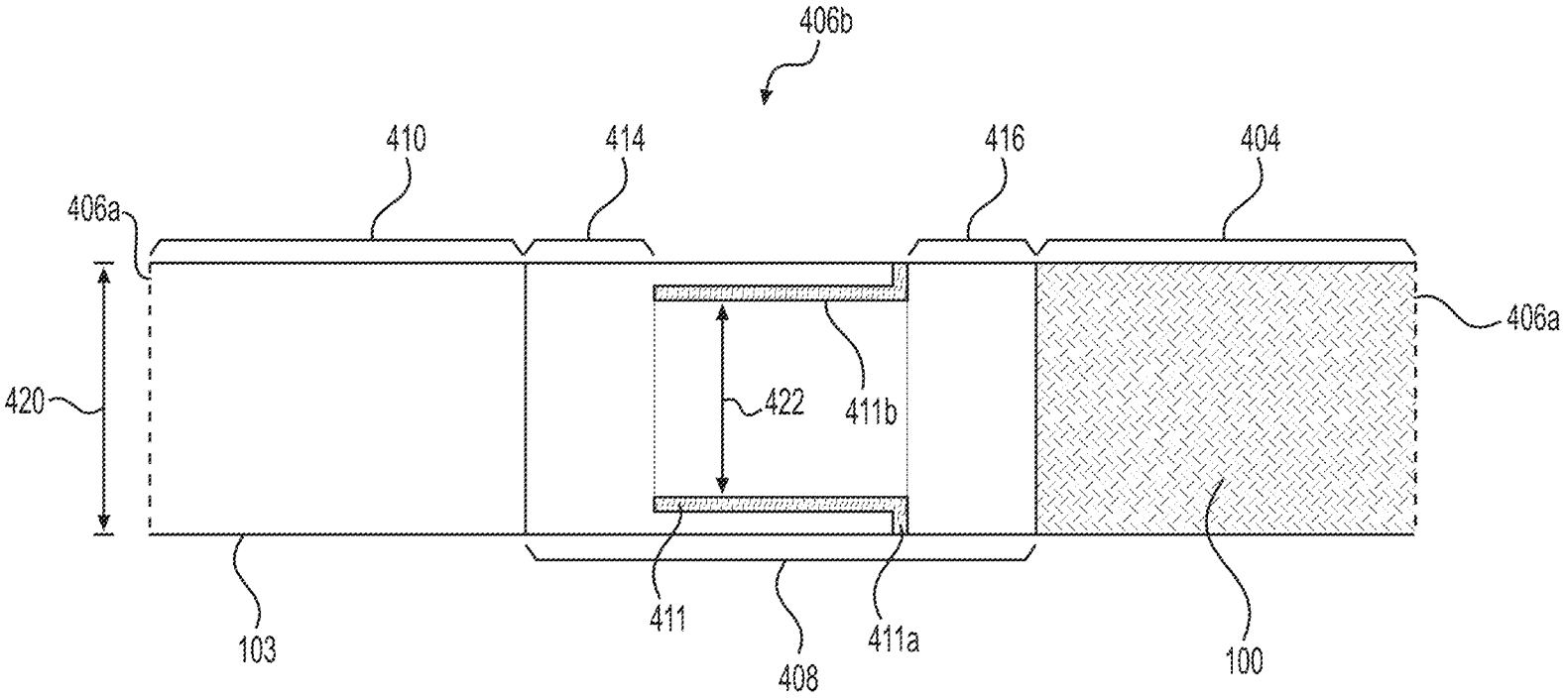
FIG. 9B is an illustration of a side-view of the matrix in an insert that is in the form of another insertable rod, in accordance with an example embodiment.

FIG. 9B is an illustration of a side-view of the matrix 100 in an insert 406*b* that is in the form of another insertable rod, in accordance with an example embodiment. Reference numbers in common with FIG. 9A are not described again here, for brevity sake. In this embodiment, a flow restrictor 411 is a "hat" flow restrictor. In this embodiment, the flow restrictor 411 relies on a brim 411*a* of the flow restrictor 411 to provide the reduced cross-sectional airflow through the restrictor 411, where an internal surface 411*b* of the restrictor 411 defines a channel with the restricted diameter 422. In an example embodiment, an airflow through the insert 406*b* flows in a direction that causes the airflow to enter and flow through the matrix 100, before passing through the flow restriction section 408 and the non-consumable filter 410.

Device with Insert According to Some Example Embodiments

Figure 10:
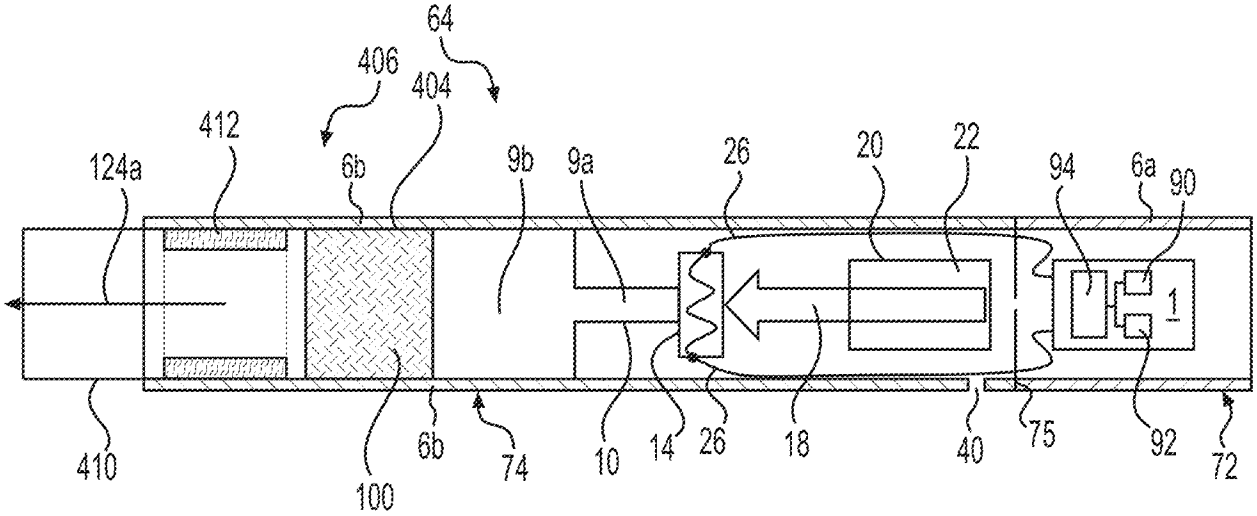
FIG. 10 is a diagram of a device with the matrix in an insertable rod, in accordance with an example embodiment.

FIG. 10 is a diagram of a device 64 with a matrix 100 in an insert 406 and/or 406*b*, such as those described above. Reference numbers in common with FIGS. 3 and 9A, 9B are not described again here, for brevity sake. In an example embodiment, an insert 406 (or 406*b*) is insertable into a distal (downstream) end of a device 64. In an example device 64 that includes multiple sections—e.g., a first section 74 and a second section 72—the insert is insertable into a distal (downstream) end of first section 74. The insert 406 (or 406*b*) may, for instance, be friction-fitted within the end of the device 64. In an example embodiment, the insert extends, at least partially, from the distal end of the device 64, such that at least part of the insert remains exposed and extends outside of device 64 once the insert is fully inserted into the device 64. In an example embodiment where at least part of a filter section 410 of an insert remains outside of the device 64 when the insert is inserted into the device, the filter 410 may act as a mouthpiece for the device 64. As stated above, the insert 406 (or 406*b*) may be disposable, whereas the device 64 and/or one or more sections thereof (if the device includes multiple sections) need not be disposable. The arrangement of the sections of an insert 406 (or 406*b*) may differ from the order shown in the drawings 9A and 9B, and depending on the arrangement, one or more sections other than the filter section may remain outside of the device 64 when the insert is inserted, and may act as a mouthpiece.

Example Methods According to Some Embodiments

Figure 11:
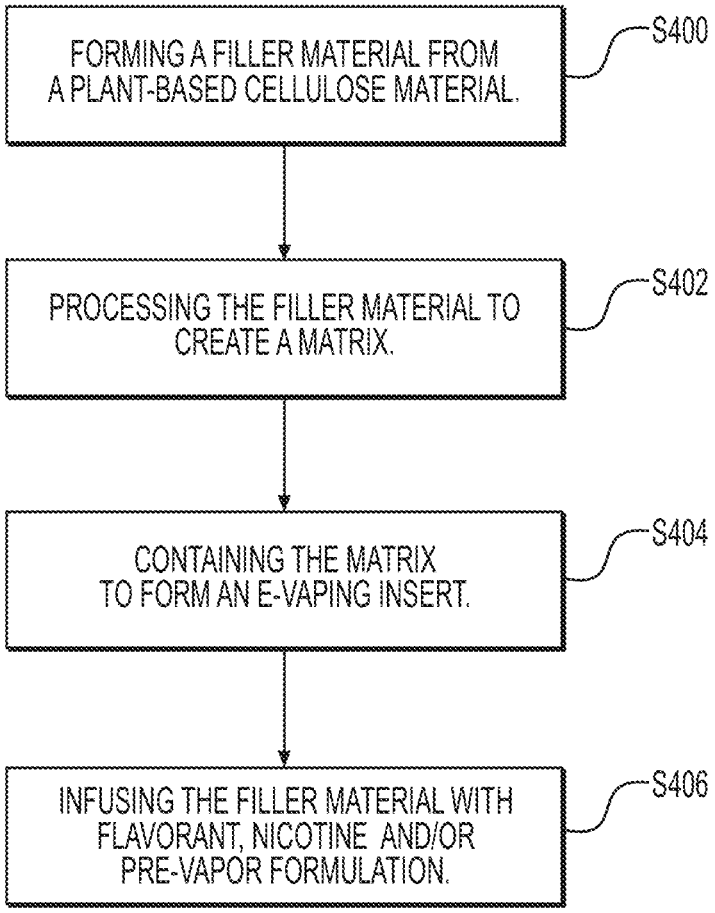
FIG. 11 is a flow chart of a method of making an insert containing a matrix, in accordance with an example embodiment.

FIG. 11 is a flow chart of a method of making an insert 104 containing a matrix 100, in accordance with an example embodiment. In step S400, filler material 105 is formed from a plant-based cellulose material. As described above, this plant-based cellulose material can either be a non-tobacco cellulose material or a tobacco cellulose.

In step S402, the filler material 105 is processed to create the matrix 100. In an example embodiment, this is accomplished by shredding the filler material 105 to form the strands 102 of the filler material 105 (as described above), where the strands 102 are then combined and/or compressed to form the matrix 100. In another embodiment, either in lieu of forming the strands 102, or in addition to forming the strands 102, portions or sheets of the filler material 105 are processed by folding, bunching or otherwise combining and/or compressing the filler material 105 to form the matrix 100 (as described above). In any of these embodiments, the filler material 105 (or strands 102 of filler material 105) may also be perforated, at some point in the processing of the filler material 105 or forming the matrix 100, to increase the interstitial spaces 101 within the matrix 100.

In step S404, the matrix 100 is contained (e.g., bound together) to form the insert 104. As described above, this may be accomplished by holding the matrix 100 together using a containing structure 103. The containing structure 103 may be made from a metal, metal alloy, polymer, plastic, resin, mesh, cellulose, plant-based cellulose, fabric, cotton, fibers, threads, other textiles, pulp, paper, tipping paper, etc., other suitable materials capable of containing the matrix 100, or combinations, or sub-combinations, of these materials. In an example embodiment, the containing structure 103 is made from the filler material 105. In an example embodiment, the matrix 100 is included in a containing structure 103 of an insert 406/406*b*.

In step S406, the filler material 105 is infused with a consumable substance. As described above, in an example embodiment the consumable substance includes a flavorant, nicotine and/or a pre-vapor formulation. In an example embodiment, the infusing of the flavorant, nicotine and/or pre-vapor formulation occurs as the filler material 105 is being formed, or after the filler material 105 is formed. In another embodiment, the infusing of the flavorant, nicotine and/or pre-vapor formulation occurs as the filler material 105 is being processed into the matrix 100, or after the matrix 100 is formed. In another embodiment, the matrix 100 is infused by the flavorant, nicotine and/or pre-vapor formulation by connecting the reservoir to the matrix 100, where the reservoir 106 contains the flavorant, nicotine and/or pre-vapor formulation.

Figure 12:
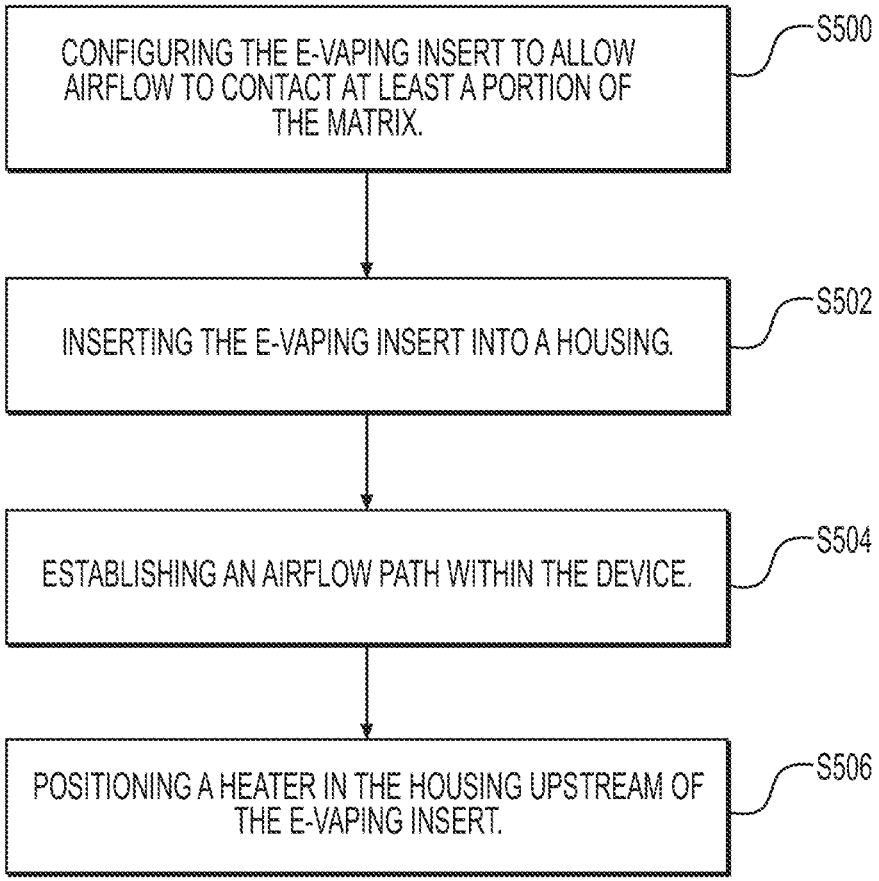
FIG. 12 is a flow chart of a method of making a device including the insert containing the matrix, in accordance with an example embodiment.

FIG. 12 is a flow chart of a method of making a device 60 (or, any of the devices disclosed in the instant example embodiments) including an insert 104 (or other inserts described herein) containing a matrix 100, in accordance with an example embodiment. In step S500, the insert 104 and/or matrix 100 is configured to allow an airflow to contact at least a portion of the matrix 100. As described above, this may be accomplished by wrapping containing structure 103 around matrix 100 in a longitudinal direction without covering upstream and downstream ends of matrix 100. In another embodiment, containing structure 103 may provide openings, with an inlet and outlet opening to allow the airflow to pass through at least a portion of the matrix 100. In another embodiment, the containing structure 103 is porous, such that the airflow is free to penetrate the containing structure 103 and flow across, or flow through, at least a portion of the matrix 100. In another embodiment, or in addition to the other embodiments, at least a portion of the containing structure 103 exposes a portion of the matrix 100 to open air, thereby allowing the airflow to contact and/or pass across at least a surface of the matrix 100.

In step S502, the insert 104 and/or matrix 100 is inserted into the housing 6*b* of the device 60 (or, any other of the devices disclosed herein). In step S504, an airflow path is established within the device 60, where the airflow path passes across, or passes through at least a portion of the matrix 100. This may be accomplished by adding the one or more air inlets 40 to the device 60 and arranging the internal structure of the device 60 to establish the airflow path. In step S506, a heater 14 is positioned in the airflow path of the device 60, upstream of the insert 104 and/or matrix 100. It should be understood that the steps of this method may apply equally to example methods of making the devices (60*a*, 62, 62*a*, 62*b*, 62*c* and 64) with the insert 104*a* or the inserts 406/406*b*.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A method, comprising:

providing a filler material that is water insoluble, the providing provides the filler material with more than 98% alpha-cellulose, 0.01% to less than 2% ash and a remainder hemicellulose;

infusing at least one first consumable within the filler material; and inserting a matrix within at least one first containing structure to form an insert, the matrix including the filler material.

2. The method of claim 1, further comprising:

shredding strands of the filler material prior to the inserting, the shredded strands defining interstices within the matrix.

3. The method of claim 1, wherein the infusing infuses the at least one first consumable which includes at least one of nicotine, at least one first flavorant, at least one first pre-vapor formulation, or combinations thereof.

4. The method of claim 1, wherein the inserting inserts the matrix so that the at least one first containing structure contacts at least side surfaces of the matrix.

5. The method of claim 1, wherein the providing provides the filler material to include a non-tobacco material that does not include material from tobacco.

6. The method of claim 1, wherein the providing provides the filler material to include tobacco.

7. The method of claim 1, wherein the inserting inserts the matrix so that the at least one first containing structure is wrapped around the matrix in a longitudinal direction, and at least one end of the matrix is not wrapped by the at least one first containing structure.

8. The method of claim 1, wherein the inserting inserts the matrix so that the at least one first containing structure is wrapped around the matrix in a longitudinal direction, and at least two ends of the matrix are not wrapped by the at least one first containing structure.

9. The method of claim 1, wherein the inserting inserts the matrix so that the at least one first containing structure is wrapped around the matrix.

10. The method of claim 1, further comprising:

first connecting a filter to the matrix to form the insert.

11. The method of claim 10, wherein the first connecting connects the filter to the matrix so that the filter is spaced apart from the matrix within the insert.

12. The method of claim 10, further comprising:

second connecting a flow restrictor to the filter and the matrix to form the insert, the flow restrictor including walls that reduce a cross-sectional flow area through the flow restrictor, the flow restrictor being between the filter and the matrix within the insert.

13. The method of claim 10, further comprising:

second connecting a flow restrictor to the filter and the matrix to form the insert, the flow restrictor including walls that reduce a cross-sectional flow area through the flow restrictor, the flow restrictor being between the filter and the matrix within the insert, the insert defining an internal void space between the walls of the flow restrictor and the filter and between the walls of the flow restrictor and the matrix.

14. The method of claim 12, wherein the first connecting and the second connecting connects the filter and the flow restrictor to the matrix by wrapping the at least one first containing structure around the matrix, the filter and the flow restrictor.

15. The method of claim 1, further comprising:

first defining an airflow passage within at least one first section;

second defining a first reservoir within the at least one first section, the first reservoir being configured to contain at least one second pre-vapor formulation;

first configuring a heater to be in communication with the first reservoir and the airflow passage; and second configuring the insert to be in selective communication with the airflow passage at a location downstream of the heater.

16. The method of claim 15, wherein the second configuring configures the insert to be selectively removable from an end of the at least one first section.

17. The method of claim 15, further comprising:

first connecting a filter to the matrix to form the insert, wherein the second configuring configures the insert to be selectively inserted into a distal end of the at least one first section to cause the filter to extend from the at least one first section.

18. The method of claim 15, further comprising:

first connecting a filter to the matrix to form the insert, wherein the second configuring configures the insert to be selectively inserted into a distal end of the at least one first section to cause the filter to extend from the at least one first section.

19. The method of claim 15, further comprising:

electrically connecting a control system to the heater;

third configuring the control system to detect at least one first parameter and send an electrical current to the heater to at least partially vaporize the at least one second pre-vapor formulation based on the at least one first parameter, the at least one first parameter being at least one of a resistance of the heater, a temperature of the heater, a draw of air in the airflow passage, or a combination thereof.

20. The method of claim 15, further comprising:

third defining a second reservoir within the at least one first section, the second reservoir being configured to contain at least one second consumable; and fifth configuring the second reservoir to communicate the at least one second consumable to the matrix, the at least one second consumable being the same as, or different than, the at least one first consumable.

21. The method of claim 20, wherein the fifth configuring configures such that the at least one second consumable includes at least one first flavorant.

* * * * *